US008382050B2

(12) United States Patent
Koop

(10) Patent No.: US 8,382,050 B2
(45) Date of Patent: Feb. 26, 2013

(54) UNIVERSAL CONNECTOR

(75) Inventor: Lars Koop, Bremerhaven (DE)

(73) Assignee: Hunter Douglas Industries BV, El Rotterdam (NL)

( * ) Notice: Subject to any disclaimer, the term of this patent is extended or adjusted under 35 U.S.C. 154(b) by 451 days.

(21) Appl. No.: 12/672,957

(22) PCT Filed: Sep. 3, 2008

(86) PCT No.: PCT/EP2008/007204

§ 371 (c)(1),
(2), (4) Date: Feb. 23, 2010

(87) PCT Pub. No.: WO2009/030474

PCT Pub. Date: Mar. 12, 2009

(65) Prior Publication Data

US 2011/0192944 A1 Aug. 11, 2011

(30) Foreign Application Priority Data

Sep. 7, 2007 (EP) ..... 07253547

(51) Int. Cl.
*A47B 96/06* (2006.01)

(52) U.S. Cl. ..... 248/220.22; 248/315; 248/222.11; 285/402; 285/411; 403/349

(58) Field of Classification Search ..... 248/220.22, 248/351, 125.7, 222.11, 222.41; 285/38, 285/312, 402, 88, 409, 411; 160/323.1; 403/348, 403/349, 97

See application file for complete search history.

(56) References Cited

U.S. PATENT DOCUMENTS

| | | | | | |
|---|---|---|---|---|---|
| 3,645,562 | A | * | 2/1972 | Fandetti et al. | 285/73 |
| 3,860,209 | A | * | 1/1975 | Strecker | 410/116 |
| 4,176,815 | A | * | 12/1979 | Davidson et al. | 248/589 |
| 4,400,856 | A | * | 8/1983 | Tseng | 24/590.1 |
| 4,457,445 | A | * | 7/1984 | Hanks et al. | 220/214 |
| 4,527,760 | A | * | 7/1985 | Salacuse | 248/108 |
| 4,795,197 | A | * | 1/1989 | Kaminski et al. | 285/12 |
| 4,858,960 | A | * | 8/1989 | Pharaon | 285/91 |
| 4,919,462 | A | * | 4/1990 | Matsui et al. | 285/149.1 |
| 5,145,276 | A | * | 9/1992 | Demange | 403/349 |
| 5,188,399 | A | * | 2/1993 | Durina | 285/91 |

(Continued)

FOREIGN PATENT DOCUMENTS

| | | | |
|---|---|---|---|
| DE | 195 26 927 | A1 | 1/1997 |
| EP | 0 735 228 | A1 | 10/1996 |

(Continued)

*Primary Examiner* — Terrell McKinnon
*Assistant Examiner* — Daniel J Breslin
(74) *Attorney, Agent, or Firm* — Dorsey & Whitney LLP

(57) ABSTRACT

A universal connector (5) is provided for connecting an architectural covering to an architectural surface. The connector has an adaptor plate (6) that is substantially circular and has one or more radially outwardly projecting flanges (16) and is arranged to be inserted into a ring-shaped engagement member (7) having one or more openings (18) in a front cover (17). The adaptor plate and the engagement member are configured such that the adaptor plate may be inserted into the engagement member by aligning the one or more flanges of the adaptor plate with a respective opening in the front cover of the engagement member and removal of the adaptor plate from the engagement member may subsequently be prevented by a partial rotation of the adaptor plate relative to the engagement member.

16 Claims, 22 Drawing Sheets

U.S. PATENT DOCUMENTS

| | | | | |
|---|---|---|---|---|
| 5,626,435 | A * | 5/1997 | Wohlhuter | 403/348 |
| 5,908,355 | A * | 6/1999 | Hoyt et al. | 464/88 |
| 6,217,248 | B1 * | 4/2001 | Reiff | 403/24 |
| 6,267,417 | B1 * | 7/2001 | Fan | 285/330 |
| 6,302,617 | B1 * | 10/2001 | Rumpp | 403/348 |
| 7,290,683 | B2 * | 11/2007 | Gerenraich | 222/180 |
| 7,581,564 | B2 * | 9/2009 | Tanaka et al. | 138/110 |
| 7,832,775 | B2 * | 11/2010 | Regener et al. | 285/377 |
| 7,988,200 | B2 * | 8/2011 | Krywitsky | 285/38 |
| 8,136,569 | B2 * | 3/2012 | Bohlen et al. | 160/323.1 |
| 8,151,859 | B2 * | 4/2012 | Koop et al. | 160/325 |
| 2008/0030334 | A1 * | 2/2008 | Marsilio et al. | 340/572.1 |
| 2008/0153606 | A1 * | 6/2008 | Koop et al. | 464/83 |
| 2009/0223102 | A1 * | 9/2009 | Li et al. | 40/763 |
| 2010/0101741 | A1 * | 4/2010 | Koop | 160/321 |
| 2010/0320758 | A1 * | 12/2010 | Sisk | 285/420 |
| 2012/0193042 | A1 * | 8/2012 | Koop et al. | 160/323.1 |

FOREIGN PATENT DOCUMENTS

| | | |
|---|---|---|
| EP | 1 936 106 A2 | 6/2008 |

* cited by examiner

UNIVERSAL CONNECTOR

CROSS-REFERENCE TO RELATED APPLICATIONS

This application is the national stage application of PCT International Application No. PCT/EP2008/007204, filed Sep. 3, 2008 and entitled "Universal Connector", which claims priority under 35 U.S.C. § 365(b) to European Patent Application No. 07253547.9 filed Sep. 7, 2007 and entitled "Universal Connector".

A wide range of coverings for architectural openings have been proposed in the past, including blinds to reduce or substantially eliminate light passing through the architectural opening. The arrangement of the covering material has been proposed in many different forms, for example a flat sheet which is rolled and unrolled from a roller, slatted or Venetian type blinds, pleated sheets which can be expanded and retracted and various multi-layer arrangements.

Frequently, the main blind body, forming a fixed end rail, is mounted above or to one side of the architectural opening. The covering may extend from this main body to a secondary moving rail, which can be pulled away from the main body across the architectural opening such that the covering covers the architectural opening. Side guides may be provided along each side of the architectural opening perpendicular to the extent of the main body, but extending in the direction of deployment and retraction of the covering. The side guides can comprise a rigid structure of some sort or merely be formed by an arrangement of cords.

In general, coverings such as those described above, suffer from the problem that they are relatively difficult to mount. The main body is relatively large in order to accommodate the retracted covering material and any retraction springs. It is necessary to secure the main body firmly above the architectural opening. Also, assembly of the various components can be somewhat complicated, requiring precise measurement and positioning of the various components. This may be especially difficult where the assembly is required at the location at which the covering is to be mounted.

In some instances, the covering may be mounted to the architectural opening such that the fixed end rail may rotate about its axis during the deployment and retraction of the covering. Accordingly, the end of the fixed end rail may be configured to freely rotate relative to the point at which it is fixed to the architectural opening. However, in other arrangements, the end of the fixed end rail may be driven to rotate by a drive mechanism, such as an electrical motor, a spring motor, a crank or a ball-chain mounted on a operating wheel. In such cases, the connection between the fixed end rail and a portion of the drive mechanism or between the drive mechanism and the attachment point to the architectural opening, if the drive mechanism is mounted to the fixed end rail, may need to be fixed so as to prevent relative rotation.

Accordingly, connectors are required that are not only easy to mount but also may connect a portion of a covering system in a rotationally fixed manner. Manufacturers have provided a plurality of such connectors. However, previously known connectors have frequently not been easy to use and it has been necessary to provide a dedicated connector for each situation, namely a dedicated connector for each combination of a covering, including any drive mechanism, and each means of connecting the covering to an architectural opening, for example for each bracket that may be used to mount the architectural covering.

It is an object of the present application to provide an improved system for mounting coverings.

According to the present invention, there is provided a connector having a first part and a second part, configured such that the first and second parts may be detachably connected. The first part may, in particular, be connectable to a part of an architectural covering and the second part may, in particular, be configured to be connected to or adjacent to an architectural opening. The first part is, in particular, a plate having a substantially circular shape, together with one or more projections, lying within the plane of the circular plate and projecting outwardly. The second part is, in particular, annular in shape and arranged to cooperate with the first part in order to provide the connection. Openings are provided in a front cover of the second part and are arranged such that the one or more protrusions of the first part may be received in a respective opening in the second part. In order to prevent removal of the first part from second part, it may be rotated such that at least part of one of the protrusions from the first part is retained behind the front cover of the second part, namely such that at least a part of one of the protrusions of the first part is no longer aligned with an opening in the second part. Accordingly, a bayonet-type fixing is provided.

Such a bayonet-type fixing is advantageous because the user may simply insert one part into the other and rotate in order to effect the connection. Accordingly, no difficult assembly of components is required. Furthermore, by arranging the second part in an annular form that interacts with the protrusions on the edge of the circular plate of the first part, the external dimensions of the second part are minimised, enabling it to be fixed to a wide variety of surfaces. In particular, such a second part may be fixed to, for example, many types of bracket or surface. Likewise, the circular plate of the first part may be fixed to a wide variety of architectural coverings. Accordingly, a single connector is provided that may be used in a large number of situations. Therefore a manufacturer need not provide a plurality of different connectors for use in different situations, namely for different combinations of coverings and mounting points.

In a convenient arrangement, the second part may be provided with a structure that may be switched between an open position, permitting relative rotation of the two parts and a closed position, preventing relative rotation of the two parts. Accordingly, once the first part has been inserted into the second part and rotated to prevent removal, the structure may be switched to the closed position, preventing any rotation of the first part relative to the second part that may allow it to be removed.

The structure for preventing rotation of the first part relative to the second part may, in particular, be arranged to interact with one or more of the protrusions on the first part when the structure is in the closed position. Accordingly, it is not necessary to provide additional features to the first part.

In a convenient arrangement, the structure for preventing relative rotation of the first and second parts may be a part of the annular shape of the second part and may be configured to rotate about one end of that part. Accordingly, in the open position, it is not aligned with the remainder of the annular-shaped second part and does not interact with the protrusions of the first part. However, when it is in the closed position, it is aligned with the rest of the annular shape of the second part and engages with at least one of the protrusions of the first part, preventing relative rotation of the first part and the second part.

Such a system may be advantageous for the user because, in the open position, it does not impede the connection of the first part to the second part. Furthermore, it may simply be closed by rotating about one end of the structure, thereby preventing rotation of the first part relative to the second part and the consequent possibility of detachment. Furthermore, because the structure is part of the annular shape of the second part, the overall size of the second part is minimised.

In a convenient arrangement, the structure for preventing relative rotation of the first and second parts may be biased towards the closed position, for example by means of a spring or other resilient member, and/or may be provided with a snap-fit connector to retain it in the closed position once it has been closed.

In a convenient configuration, the second part may include a fixing that is configured such that, when the first part is inserted into the second part and rotated, it permits sufficient rotation to ensure that the protrusions of the first part are secured behind the front cover of the second part and ensures that the orientation of the first part relative to the second part is such that the structure for preventing relative rotation of the first and second parts can be closed without further rotation of the first part relative to the second part.

Beneficially, such an arrangement facilitates the use of the structure for preventing relative rotation of the first and second parts because it automatically ensures that the first and second parts are appropriately aligned for closing the structure. In other words, the user need not take special care to provide the required alignment. Without such a feature, the user may have to either repeatedly try different alignments and then check to see if the structure may be closed or may need to adjust the relative alignment with one hand and attempt to close the structure with the other until the required alignment is achieved. Clearly, such an arrangement is more difficult for the user to use.

In a convenient arrangement, the second part may include one or more inwardly oriented protrusions that are configured such that when at least one of the protrusions of the first part abuts at least one of the protrusions of the second part, the orientation of the first part relative to the second part is such that the structure for preventing relative rotation may be closed. Advantageously, such an arrangement does not require any increase in the external dimensions of the second part.

The second part may have a greater number of openings than the number of protrusions on the first part. Alternatively or additionally, the first part may have a plurality of protrusions that are arranged in a rotationally symmetric fashion, namely evenly spaced round the circular plate of the first part. Accordingly, the first part may be inserted into the second part at a plurality of orientations. Accordingly, by providing a plurality of orientations at which the first part may be inserted into the second part, it is easier for the user to connect the first part to the second part. For example, there may be eight or more orientations at which the first part may be inserted into the second part. As a result, the most that a user will need to rotate a first part relative to a second part in order to insert it is 22.5°, assuming that the protrusions and openings are evenly spaced. Consequently, it is easy for a user to align the protrusions with a respective opening and to insert the first part into the second part.

In a convenient arrangement, the connector may be arranged such that, when the second part is mounted to a surface and the first part is inserted into the second part, the first part abuts said surface. Such an arrangement enables the external dimensions of the connector to be minimised. For example, the depth of the second part, namely its thickness in a direction perpendicular to a plane in which the annular shape lies, may be limited to the sum of the thickness of the first part and the thickness of the front cover of the second part. Minimising the external dimensions of the connector facilitates its use in a plurality of circumstances, namely ensures that it may be used for a large number of combinations of architectural coverings and means of mounting to architectural surfaces.

In order to ensure that the connector is as easy as possible for a user to operate, it may be configured such that, once the projections of the first part have been inserted into the openings of the second part, the first part may be rotated relative to the second part in either direction without affecting the operation of the connector. For example, if the second part is provided with one or more projections in order to stop the rotation of the first part relative to the second part at an appropriate orientation such that the structure for preventing rotation may be closed, the projections of the second part may be configured such that, regardless of the direction in which the first part is turned, when one or more of the projections on the first part abuts a projection on the second part, the first part is appropriately positioned relative to the second part for the structure for preventing rotation to be closed.

In a convenient arrangement, the first part may include fittings that allow the circular plate to be connected to a part of the architectural covering. For example, the plate may have holes that are provided to connect the plate to the architectural covering by appropriate fastening means, such as screws and/or bolts or any other appropriate means. A snap-fit connection may alternatively or additionally be provided.

In a convenient arrangement, the first part may be configured such that the architectural covering may be configured to be attached substantially at the centre of the circular plate from which the first part is formed.

In a convenient arrangement, the second part may be provided with fittings that allow the second part to be connected to a surface. For example, the second part may include holes for connecting the second part to a surface by appropriate fixing means, such as screws and/or bolts. A snap-fit connection may alternatively or additionally be provided.

The fittings for connecting the second part to a surface may be configured to permit the second part to be connected directly to an architectural surface, such as a wall, a ceiling, a soffit, or any other surface in the vicinity of an architectural opening.

Alternatively or additionally, the fittings may be configured such that the second part may be connected to a bracket which is configured to be mounted on a wall or other architectural surface. Accordingly, the connector may be used in a variety of circumstances.

In a convenient arrangement, as described above, the fittings for connecting the second part to a surface may include through holes for connecting the second part to the surface by means of screws and/or bolts. These may be arranged in the front cover of the second part. In particular, such a through hole may be arranged approximately midway between two of the openings in the front cover. In particular, if the second part further includes projections arranged to stop the rotation of the first part at a desired orientation by abutting the projections of the first part, each of the through holes may pass through such a projection. In this manner, a fixing means passing through the through holes will not interfere with a projection on the first part when it is rotated the required amount to connect the first part to the second part but the external dimensions of the second part need not be increased in order to provide space for the through holes.

The invention will be more clearly understood from the following description, given by way of example only, with reference to the accompanying drawings, in which.

Figure 1:
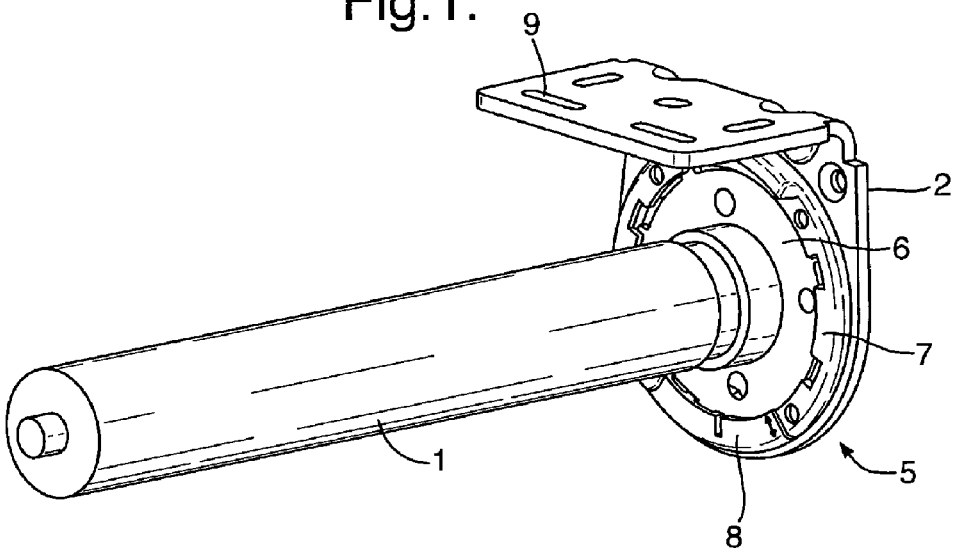
FIG. 1 is a perspective view of an embodiment of a connector according to the present invention.
Figure 2:
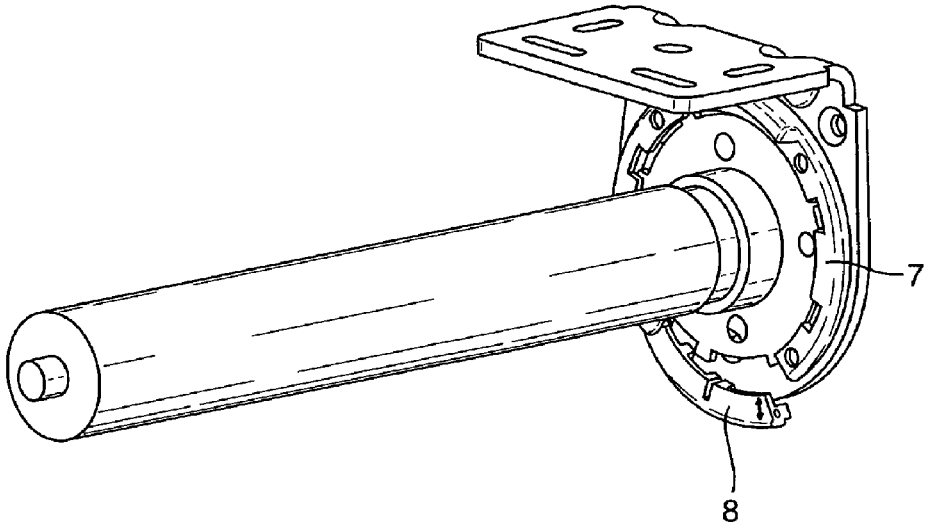
FIG. 2 is a perspective view of said embodiment in a second position.
Figure 16:
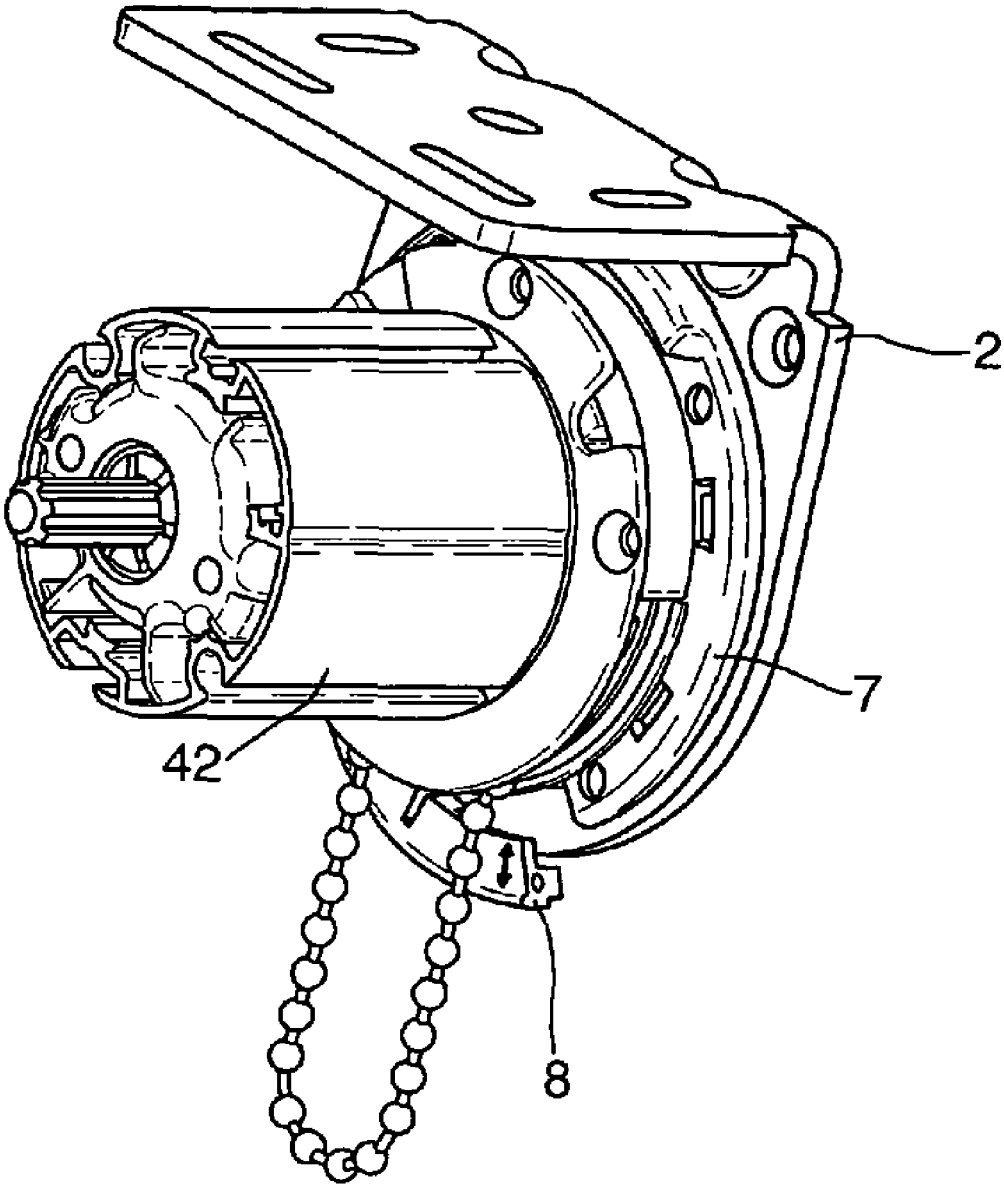
Figure 17:
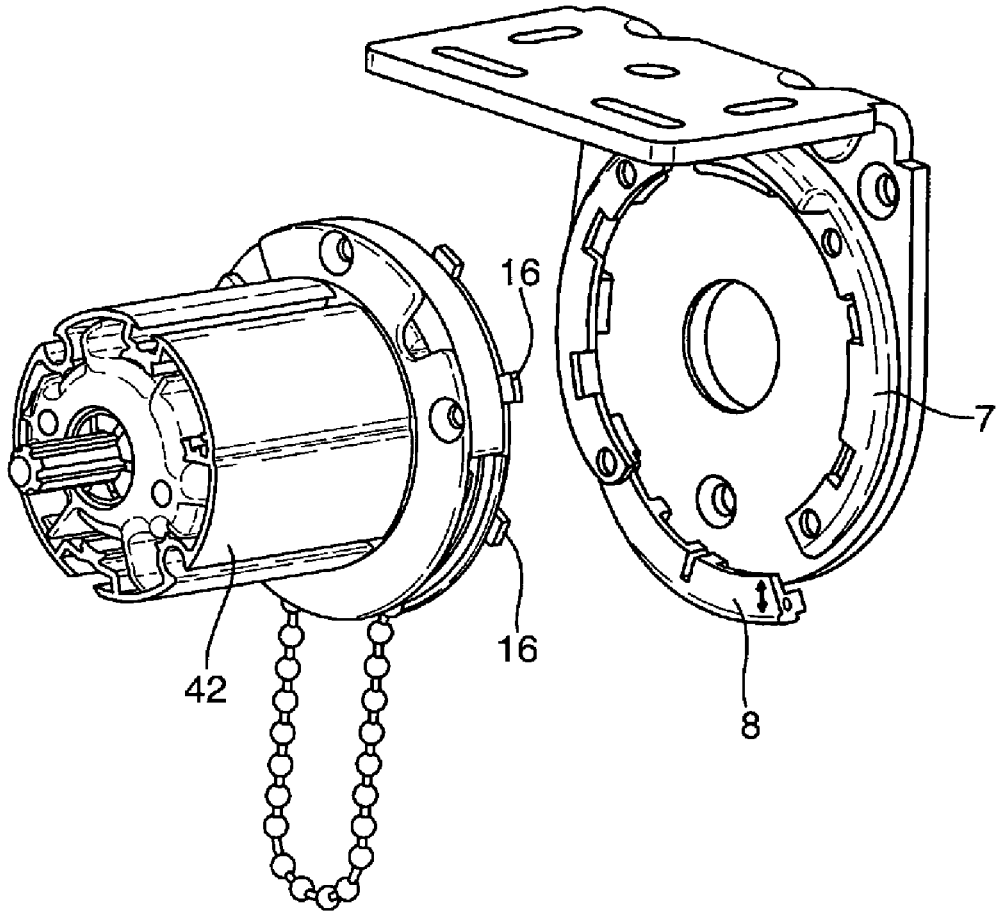
Figure 18:
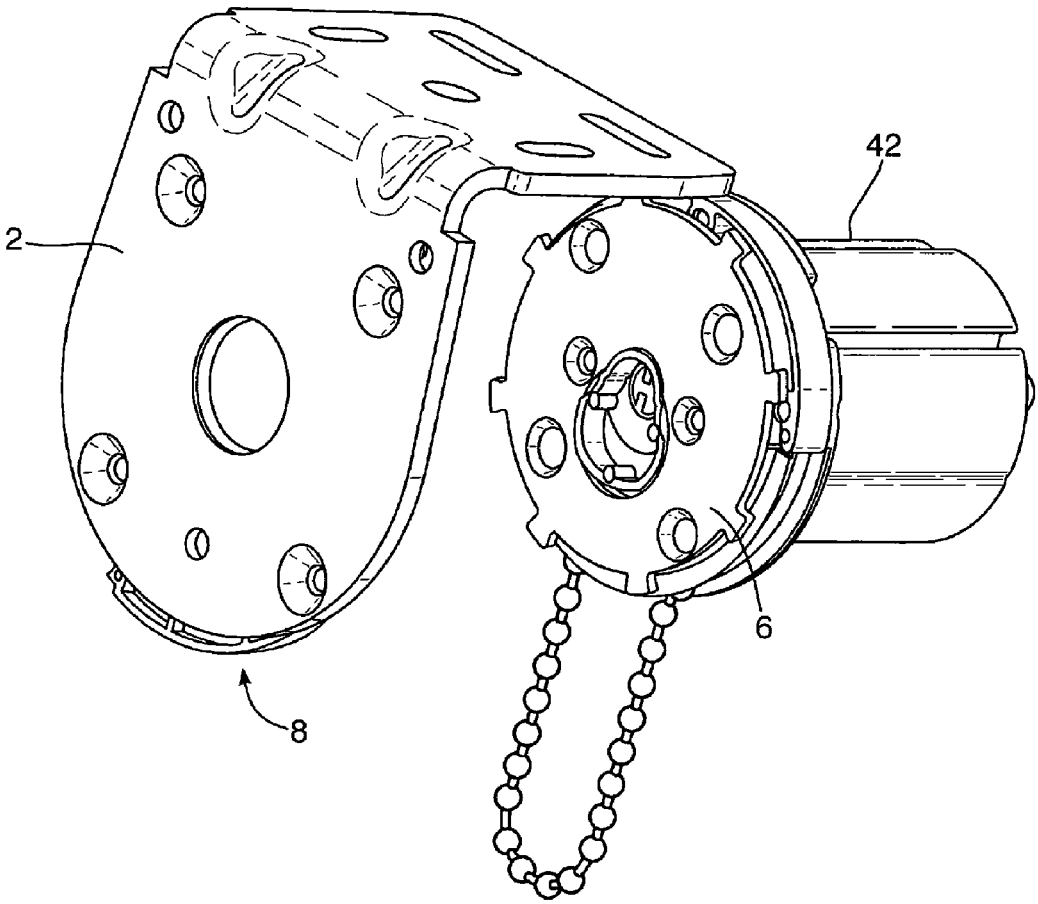

FIGS. 16 to 18 depict a connector of the embodiment of FIG. 1 in a further different use; and FIGS. 19 to 25 depict a variant of the connector FIGS. 1 to 11 depicts how an embodiment of the invention may be constructed and how it may be used in a particular situation. Specifically, it shows how a connector according to the present invention may be used to connect a tubular motor 1 of, for example, a powered roller blind to a bracket 2 that may be mounted to any appropriate architectural surface, such as a wall, ceiling, soffit or any other surface within a structure, such as a building.

The connector 5 has an adaptor plate 6 that is connected to the tubular motor 1 and an engagement member 7 that is connected to the bracket 2. The engagement member 7 has a locking hatch 8 which is described in further detail below. As shown, the bracket 2 has a plurality of holes 9 that enable the bracket to be mounted to a surface at an appropriate angle by suitable fixing means, such as by screws or any other suitable fixing means.

FIG. 1 depicts the connector 5 in a position in which it is fully connected, namely in which the adaptor plate 6 is connected to the engagement member 7, connecting the tubular motor 1 to the bracket 2 in order to fix both the relative position of the tubular motor and the bracket and to prevent any relative rotation.

Figure 3:
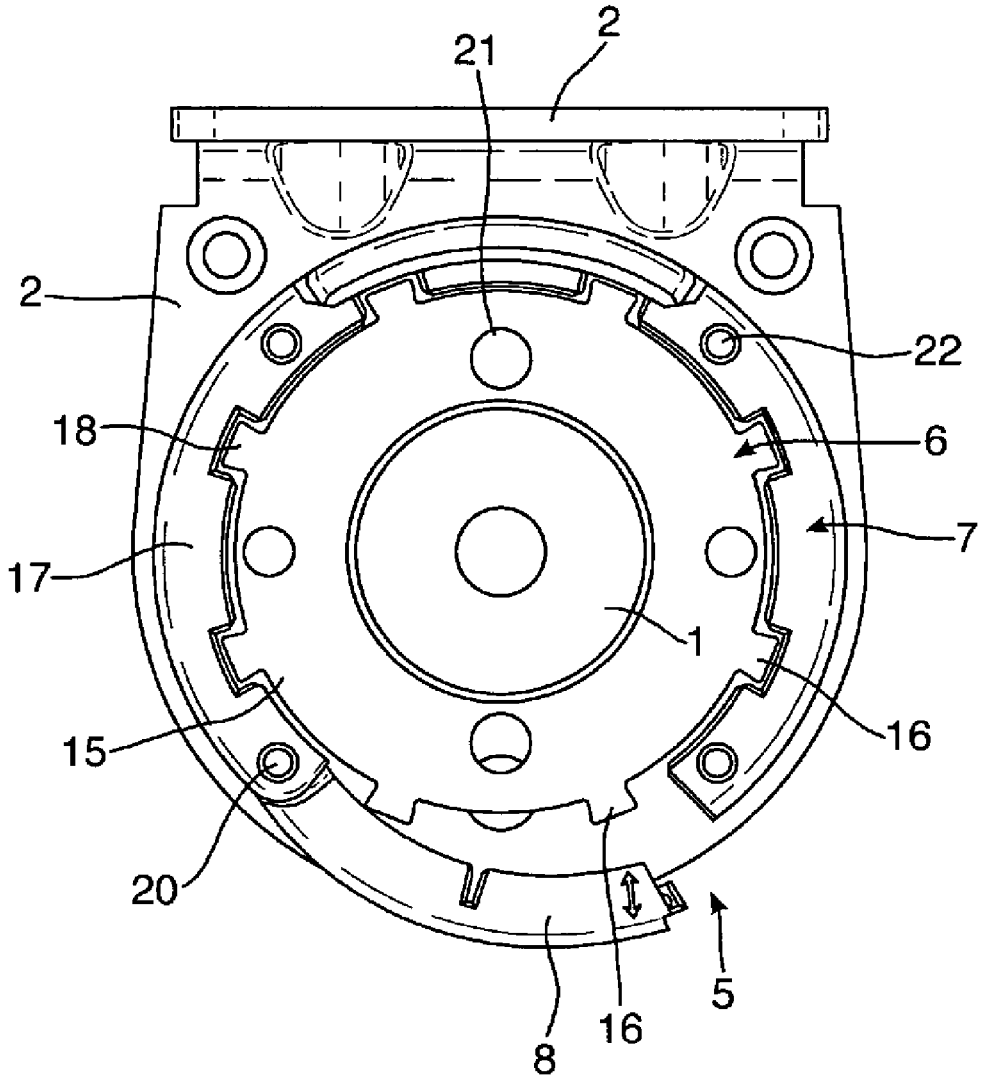
FIG. 3 is a front elevation of said embodiment in a third position.

FIG. 3 is a front elevation of the connector 5. By front elevation in this description, it is meant a view of the connector from the side of the connector 5 that is connected to an architectural covering, in this case to the tubular motor 1 of the architectural covering. Likewise, a rear elevation is a view of the connector from the other side. However, it should be appreciated that the connector 5 of the invention may be used in any required orientation.

As shown in FIG. 3, the adaptor plate 6 comprises a circular plate 15 and a plurality of regularly spaced outwardly projecting flanges 16. In the embodiment depicted in the figures, the adaptor plate 6 has eight radially outwardly projecting flanges 16. However, it should be appreciated that any number of flanges 16 may be used.

The engagement member 7 is generally ring-shaped and, in particular, has a front cover 17 that is generally annular in shape. For the avoidance of doubt, it should be appreciated that in this application, the use of the term "front cover" does not define any orientation of the engagement member 7 but merely defines the side of the engagement member 7 that is adapted to receive the adaptor plate 6. The inner dimension of the annular-shaped front cover of the engagement member 7 is slightly larger than the outer dimension of the circular plate 15 of the adaptor plate 6. In addition, the front cover 17 of the engagement member 7 has a plurality of openings 18 that are slightly larger than the size of the radially outwardly projecting flanges 16 of the adaptor plate 6. The openings 18 in the front cover 17 of the engagement member 7 are configured such that the radially outwardly projecting flanges 16 of the adaptor plate 6 may be aligned with an opening 18 in the front cover 17 of the engagement member 7. Accordingly, the adaptor plate 6 may be inserted into the engagement member 7, passing beyond the front cover 17 of the engagement member 7.

Figure 4:
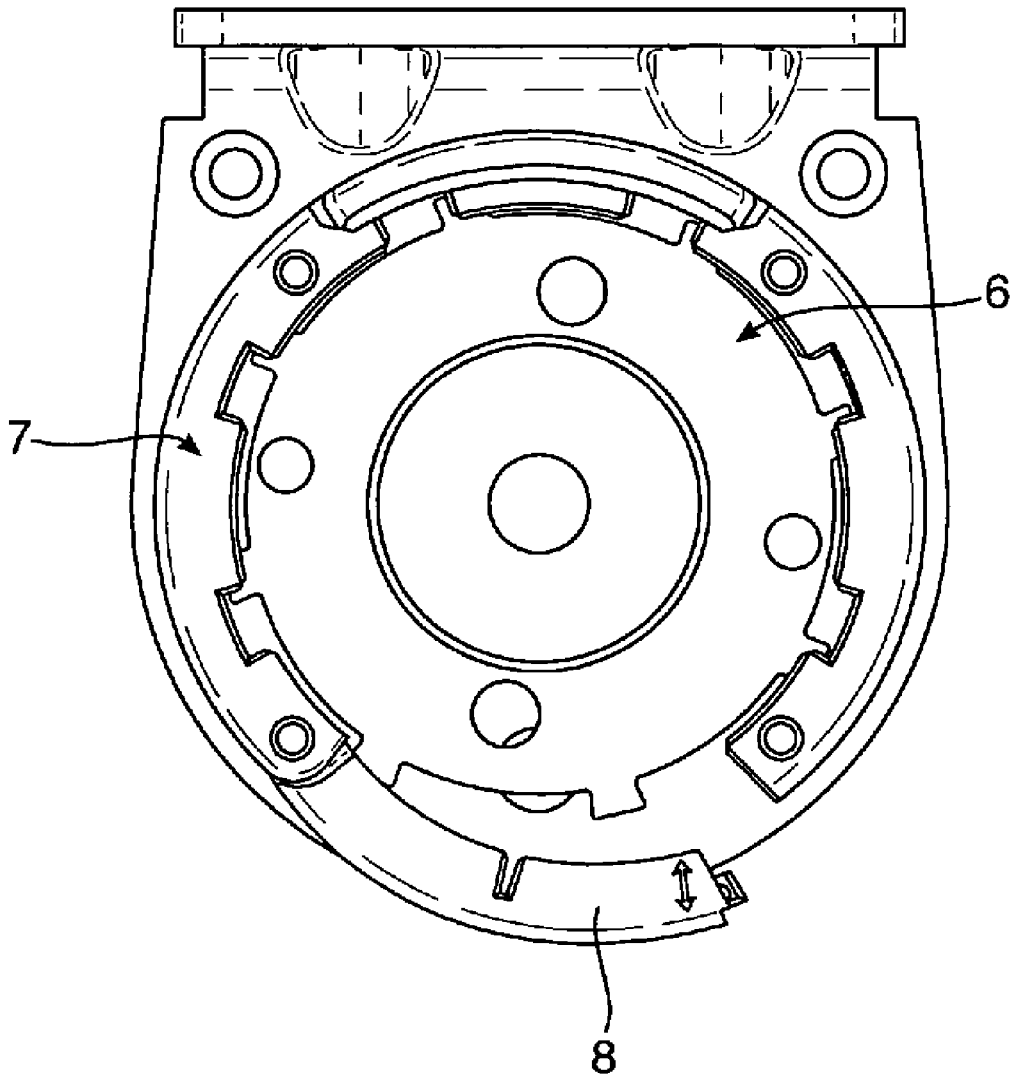
FIG. 4 is a front elevation of said embodiment in a fourth position.
Figure 5:
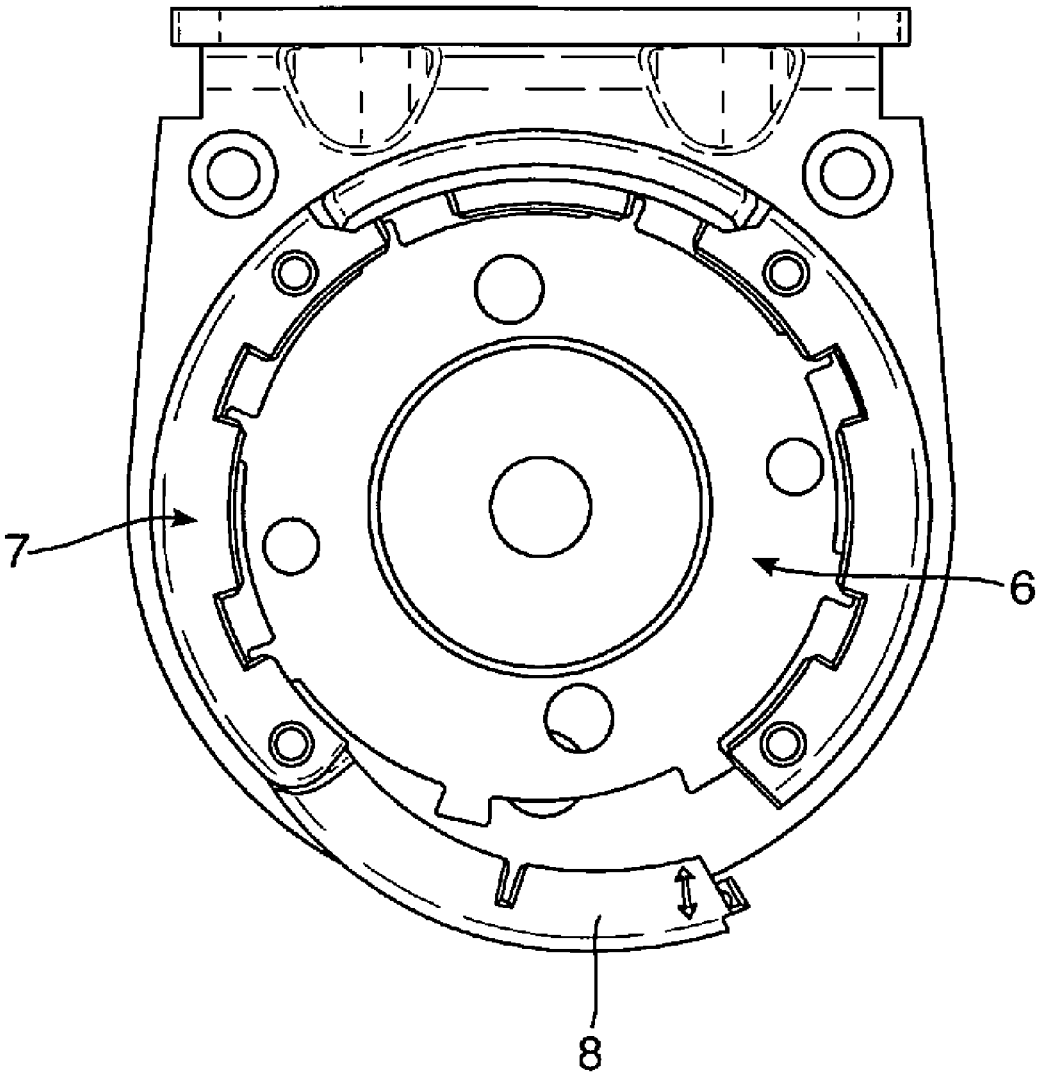
FIG. 5 is a front elevation of said embodiment in the second position.

As shown in FIGS. 4 and 5, once the adaptor plate 6 has been inserted into the engagement member 7, it may be rotated such that the radially outwardly projecting flanges 16 of the adaptor plate at least partly pass behind a portion of the front cover 17 of the engagement member 7. Accordingly, once at least part of one of the radially outwardly projecting flanges 16 of the adaptor plate are behind a portion of the front cover 17, the adaptor plate 6 cannot be removed from the engagement member 7, namely they are connected. As is shown in FIGS. 4 and 5, the adaptor plate 6 may be rotated in either direction relative to the engagement member 7 to provide the connection.

Figure 6:
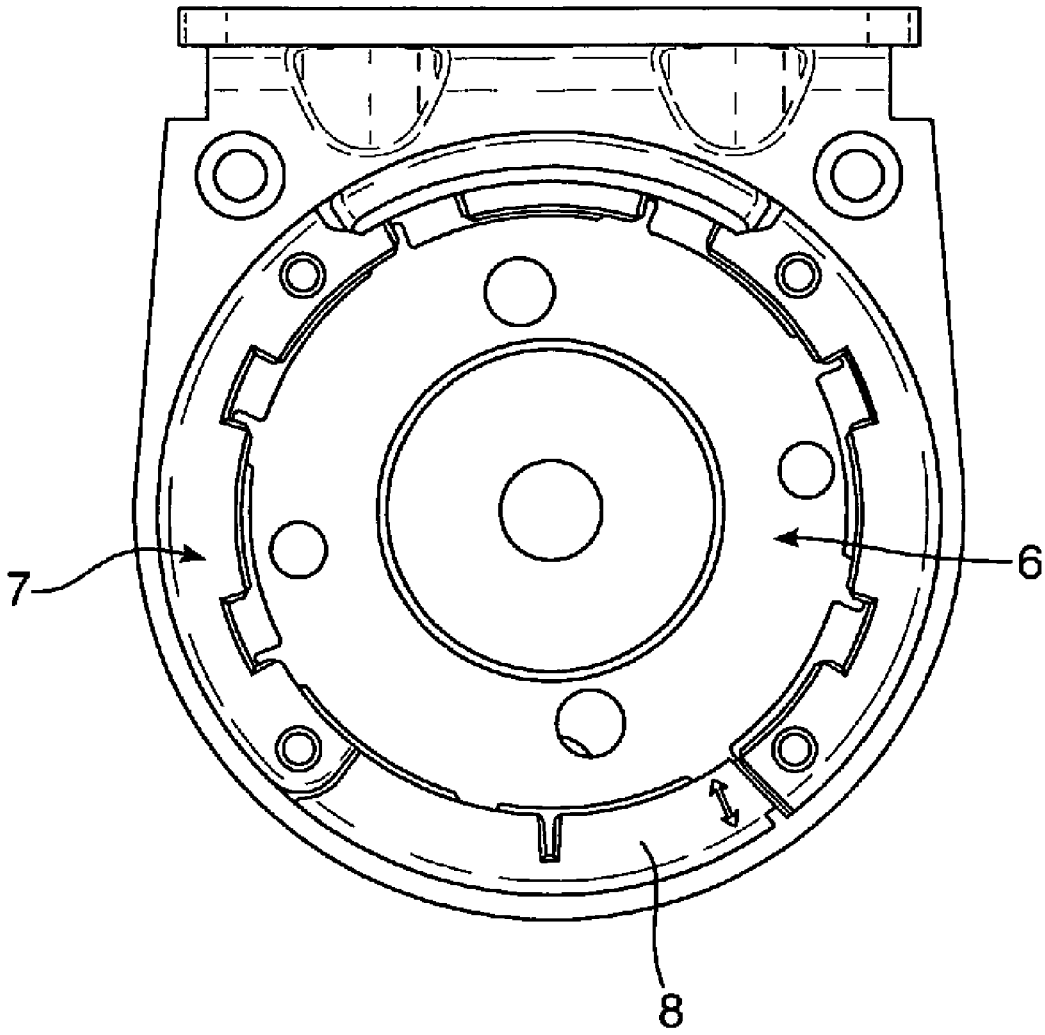
FIG. 6 is a front elevation of said embodiment in the first position.

As shown in FIG. 6, once the adaptor plate 6 has been rotated relative to the engagement member 7, the locking hatch 8 may be closed. The purpose of the locking hatch 8 is to prevent subsequent rotation of the adaptor plate 6 relative to the engagement member 7, namely to prevent rotation such that the radially outwardly projecting flanges 16 of the adaptor plate 6 are aligned with openings 18 of the front cover 17 of the engagement member 7 so as to permit the removal of the adaptor plate 6 from the engagement member 7.

As shown, the locking hatch 8 of this embodiment forms a portion of the ring-shaped engagement member 7 and is arranged to pivot about a point 20 at one end of the locking hatch 8. Accordingly, the locking hatch 8 may move between an open position, depicted in FIGS. 2 to 5, and a closed position, depicted in FIG. 6, in which the locking hatch 8 is aligned with the remainder of the ring-shaped engagement member 7.

Further description of the locking hatch 8 of the embodiment of the invention depicted in the figures is provided below. However, it should be appreciated that alternative means for preventing rotation of the adaptor 6 relative to the engagement member 7 may be provided. For example a pin or other protrusion may be provided that can be inserted into the engagement member 7 to prevent relative rotation of the adaptor plate 6. The pin or protrusion may be configured to be inserted between the radially outwardly projecting flanges 16 of the adaptor plate 6 or to additionally pass through an opening in one of the flanges 16. It will therefore be appreciated that, although in the arrangement depicted in FIGS. 2 to 6, the front cover 17 of the engagement member 7 does not form a complete annulus when the locking hatch is open, namely when the adaptor plate 6 is free to rotate relative to the engagement member 7, this need not be the case. Accordingly, an embodiment of the invention utilising a different means for preventing rotation of the adaptor plate 6 relative to the engagement member 7 may include an engagement member 7 having a front cover 17 forming a complete annulus. Consequently, additional openings 18 may be provided for the radially outwardly projecting flanges 16 of the adaptor plate 6 (which are not necessary in an arrangement such as that depicted in FIG. 3, in which a portion of the front cover 17 is rotated out of alignment with the remainder of the annulus when the adaptor plate 6 is being inserted into the engagement member 7).

As shown in, for example, FIG. 3, the adaptor plate 6 of the presently described embodiment includes openings 21 that may be used to attach the adaptor plate 6 to a part of the architectural covering to be connected to the bracket 2 by the connector 5. It should be appreciated that the openings 21 visible in FIG. 3 are those which are not required for connecting the tubular motor 1 to the adaptor plate 6 in this instance. However, by providing a plurality of openings 21 in the adaptor plate, a variety of different architectural coverings or parts thereof, may be connected to the same adaptor plate.

Likewise, the engagement member 7 has a plurality of openings 22 by which it may be connected to the bracket 2. The openings 22 of the engagement member 7 are located within the front cover 17 and in the embodiment depicted are, in particular, arranged midway between openings 18 in the front cover 17 of the engagement member 7. Accordingly, fixing means inserted through the openings 22 in the engagement member 7 will not interfere with the radially outwardly projecting flanges 16 of the adaptor plate, either when the adaptor plate 6 is being inserted into the engagement member 7 or when it is rotated to prevent removal. Furthermore, by arranging the openings 22 in the engagement member 7 in this fashion, the external dimensions of the engagement member 7 need not be increased.

Generally, therefore, the radial size of the engagement member 7 is only marginally larger than the radial dimension of the adaptor plate 6. Furthermore, the engagement member 7 does not require any particular features of shape or configuration to be provided on the surface to which it is to be attached. Accordingly, therefore, the engagement member 7 may be connected to a variety of different brackets or may be connected directly to an architectural surface to which it is desired to connect the architectural covering.

In summary, the adaptor plate 6 may be connected to a variety of architectural coverings and the engagement member 7 may be connected to a variety of architectural surfaces in a plurality of different manners. Accordingly, a manufacturer may use one universal connector 5 in many situations.

It should be appreciated that the adaptor plate 6 and the engagement member 7 may be connected to the architectural covering, bracket and/or architectural surface by any appropriate fixing means, such as by screws and/or bolts passing through openings 21,22 such as those described above. Alternatively or additionally, other convenient fixing means, such as snap-fit connectors may be used as appropriate.

FIGS. 7, 8, 9 and 10 provide rear elevations of the connector 5 in positions corresponding to FIGS. 3, 5, 4 and 6, respectively. It will be appreciated that the bracket 2 is not depicted in the figures for clarity. From the rear view depicted in FIGS. 7 to 10, the not previously visible openings 21 in the adaptor plate 6 that are used in the arrangement depicted in the FIGS. 1 to 10 to connect the tubular motor 1 are clearly shown.

Figure 7:
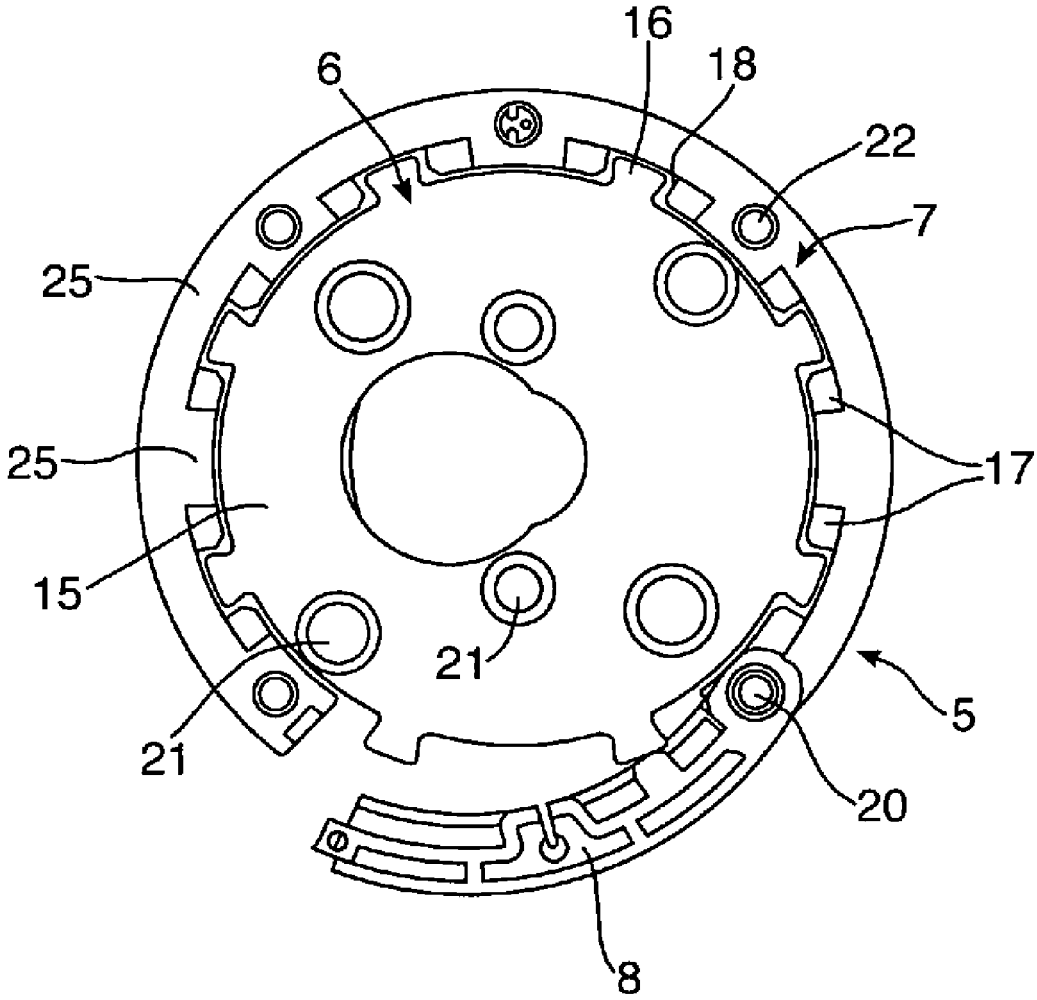
FIG. 7 is a rear elevation of said embodiment in the third position.
Figure 8:
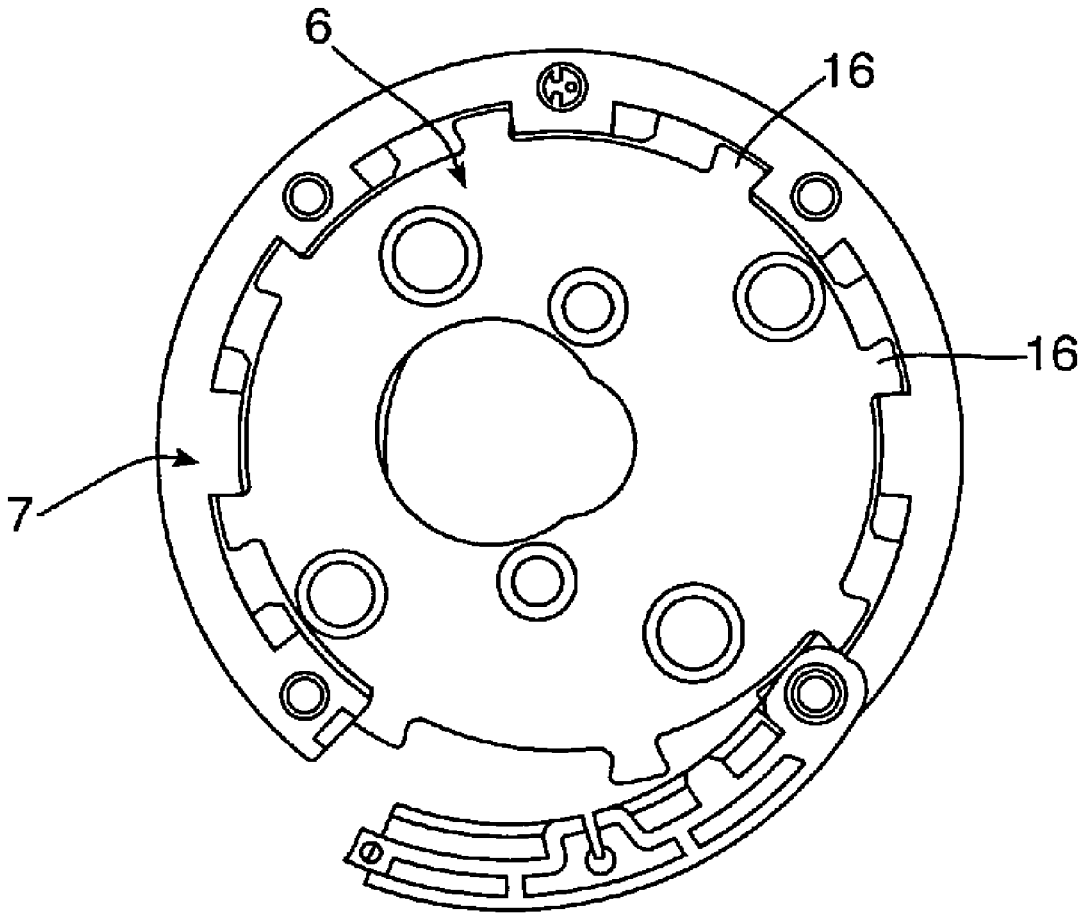
FIG. 8 is a rear elevation of said embodiment in the second position.
Figure 9:
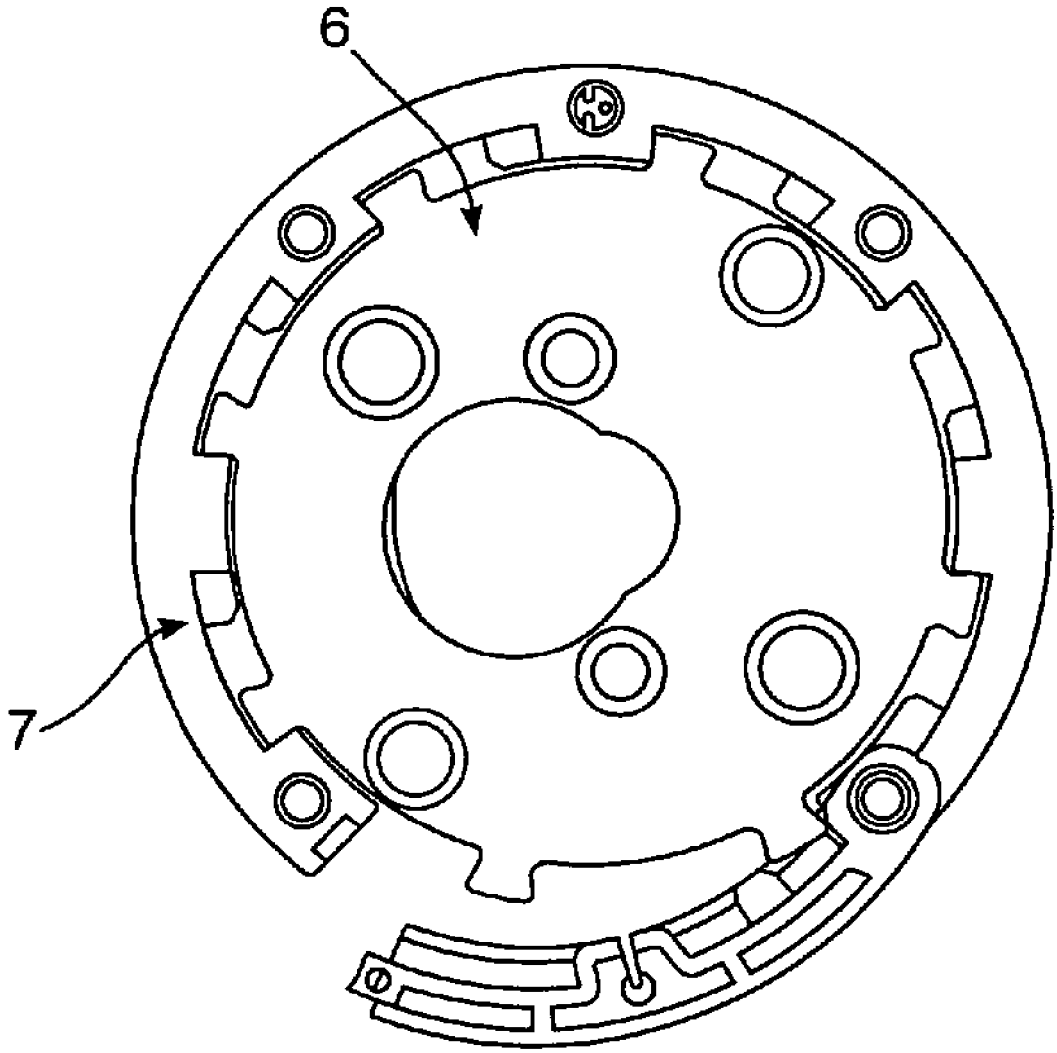
FIG. 9 is a rear elevation of said embodiment in the fourth position.

FIG. 7 shows the connector 5 at the point at which the radially outwardly projecting flanges 16 of the adaptor plate are aligned with the openings 18 of the front cover 17 of the engagement member 7 to allow insertion/removal of the adaptor plate 6 into/out of the engagement member 7. The front cover 17 of the engagement member 7 is only partially visible beyond the rear cover 25 of the engagement member 7.

As shown, the rear cover 25 of the engagement member 7 includes a plurality of inwardly projecting flanges 26. The radially inwardly projecting flanges 26 of the rear cover 25 of the engagement member 7 are configured such that they do not interfere with the circular plate 15 of the adaptor plate 6 when it is inserted into the engagement member 7. However, the radially inwardly projecting flanges 26 of the rear cover 25 of the engagement member 7 are configured to abut the radially outwardly projecting flanges 16 of the adaptor plate 6 when it is rotated such that radially outwardly projecting flanges 16 of the adaptor plate are at least partially behind the front cover 17 of the engagement member 7.

As explained above and as depicted in FIGS. 8 and 9, the radially inwardly projected flanges 26 of the rear cover 25 of the engagement member 7 are configured such that the adaptor plate 6 may be rotated in either direction and the radially outwardly projecting flanges 16 of the adaptor plate 6 will, in either case, abut radially inwardly projecting flanges 26 of the rear cover 25 of the engagement member 7.

It should be noted that in this embodiment the openings 22 in the engagement member 7 that are used to connect the engagement member 7 to the surface to which it is to be mounted are aligned with the radially inwardly projecting flanges 26 of the engagement member 7. Consequently, in line with the nature of the radially inwardly projecting flanges 26 of the rear cover 25 of the engagement member 7, these through holes do not interfere with the correct movement of the radially outwardly projecting flanges 16 of the adaptor plate 6.

Figure 10:
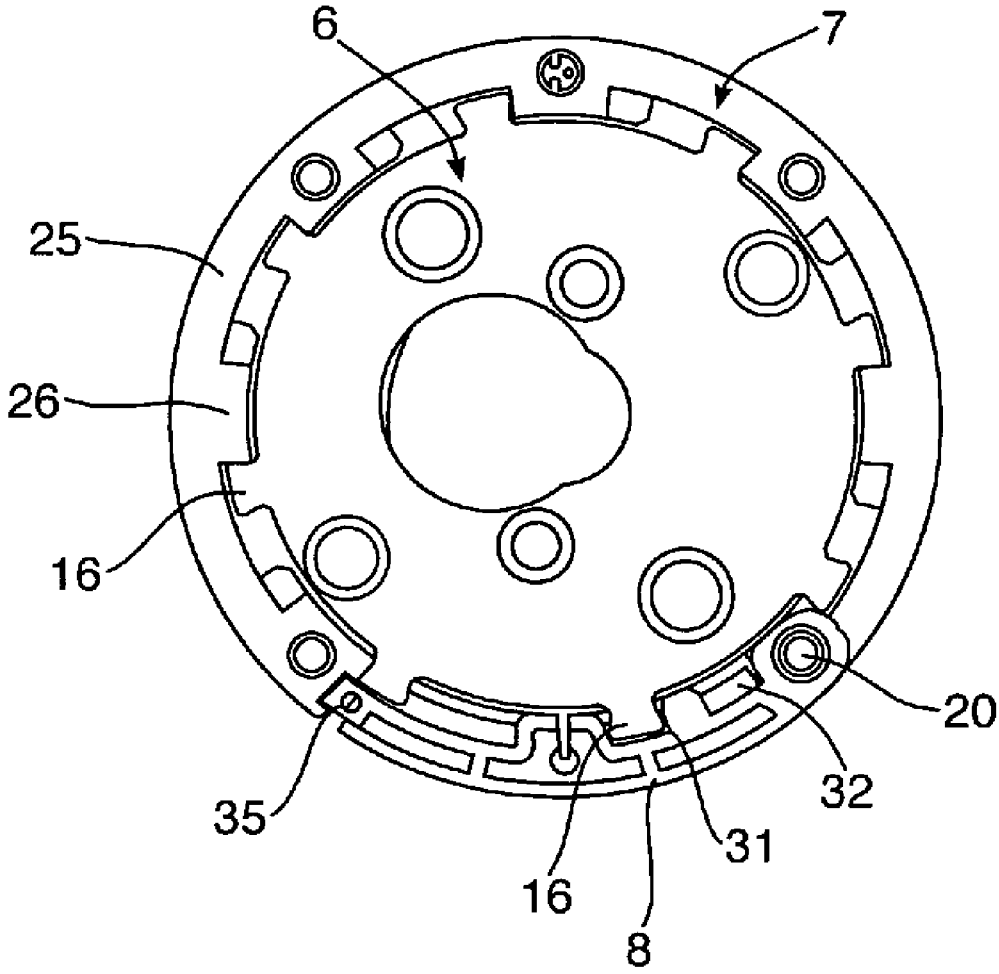
FIG. 10 is a rear elevation of said embodiment in the first position.

The provision of the radially inwardly projecting flanges 26 of the rear cover 25 of the engagement member 7 may firstly prevent the adaptor plate 6 from being over-rotated, namely rotated such that the radially outwardly projecting flanges 16 of the adaptor plate are aligned with subsequent openings 18 of the front cover 17 of the engagement member 7 such that it may be removed. In addition, as shown in FIG. 10, the radially inwardly projecting flanges 26 of the rear cover 25 of the engagement member 7 may be positioned such that, when the radially outwardly projecting flanges 16 of the adaptor plate 6 abut the radially inwardly projecting flanges 26 of the rear cover 25 of the engagement member 7, at least one of the radially outwardly projecting flanges 16 of the adaptor plate 6 is appropriately aligned such that the locking hatch 8, or another means of preventing subsequent rotation, may be closed. Further, as shown, a recess 31 in the locking hatch 8 is in that case positioned to engage with that radially outwardly projecting flange 16 of the adaptor plate 6 such that, when the locking hatch 8 is closed, the adaptor plate 6 cannot rotate relative to the engagement member 7.

As shown in FIG. 10, the locking hatch 8 may include a first recess 31 for engagement with a radially outwardly projecting flange 16 of the adaptor plate 6 when the adaptor plate 6 has been rotated relative to the engagement member 7 in a first direction and a second recess 32 for engaging the radially outwardly projecting flange 16 of the adaptor plate 6 when the adaptor plate 6 has been rotated relative to the engagement member 7 in the opposite direction.

Furthermore, as shown in FIG. 10, the locking hatch 8 may be provided with a snap-fit connection that, once the locking hatch has been closed, holds the locking hatch 8 in the closed position, for example until a user actively opens the locking hatch 8. Alternatively or additionally, a resilient member such as a spring, may be provided to bias the locking hatch 8 to the closed position.

Figure 11:
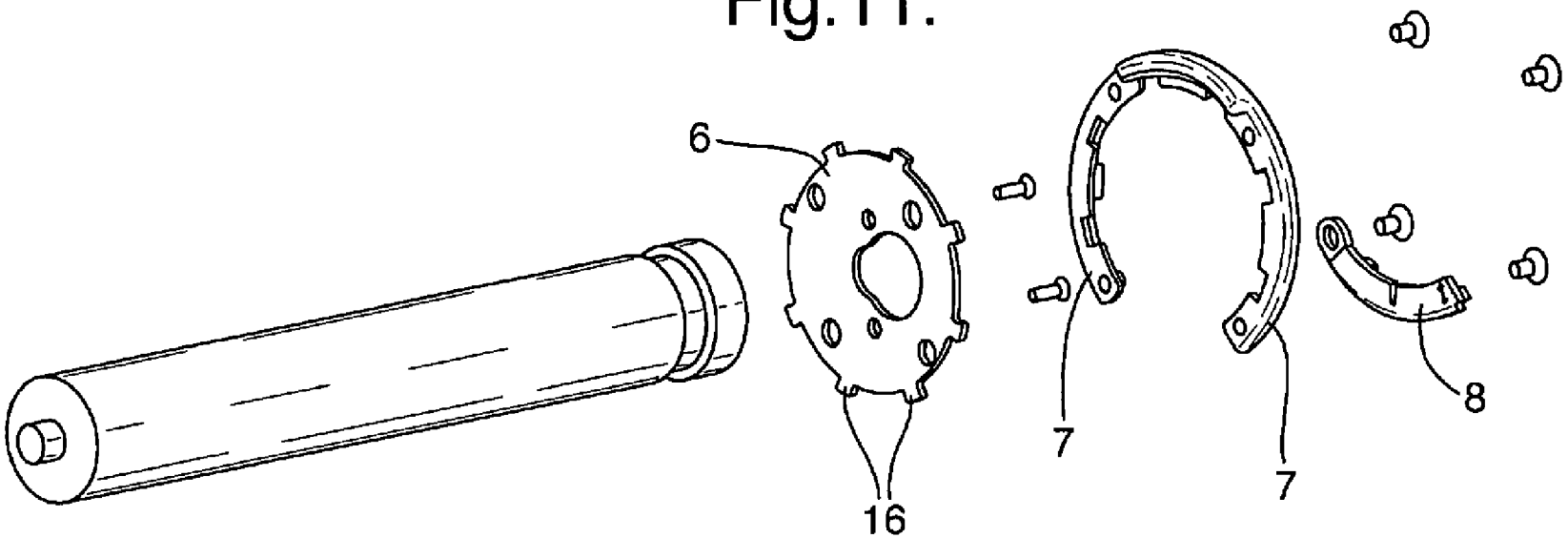
FIG. 11 is an exploded perspective view of said embodiment.
Figure 12:
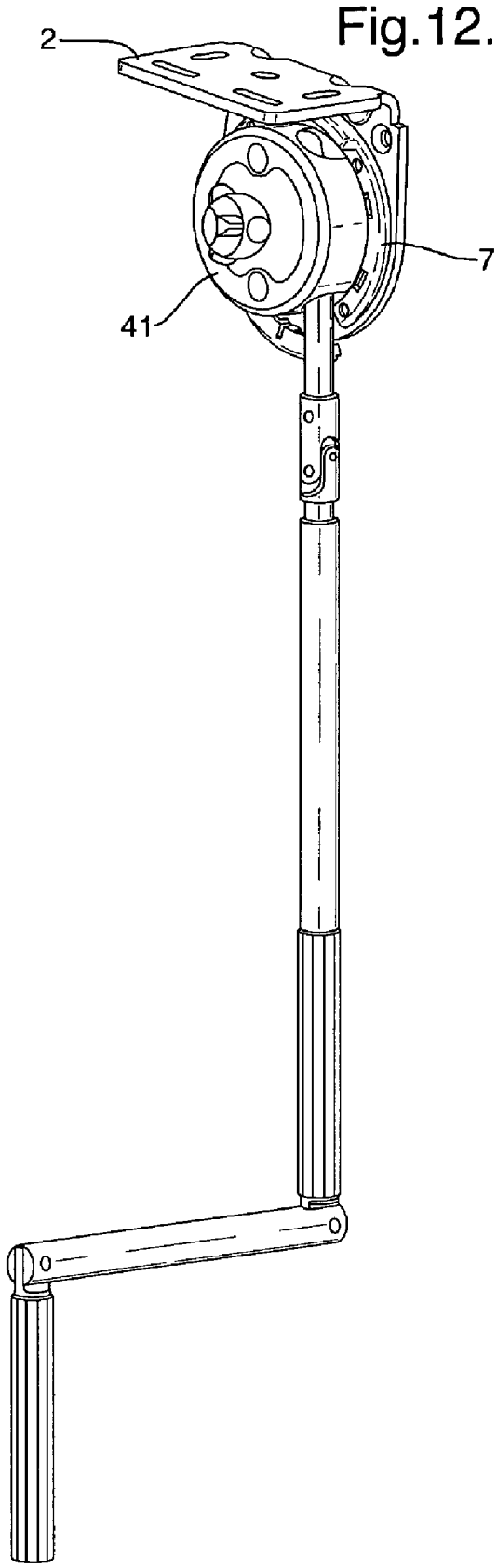
FIGS. 12 to 15 depict a connector of the embodiment of FIG. 1 in a different use.
Figure 13:
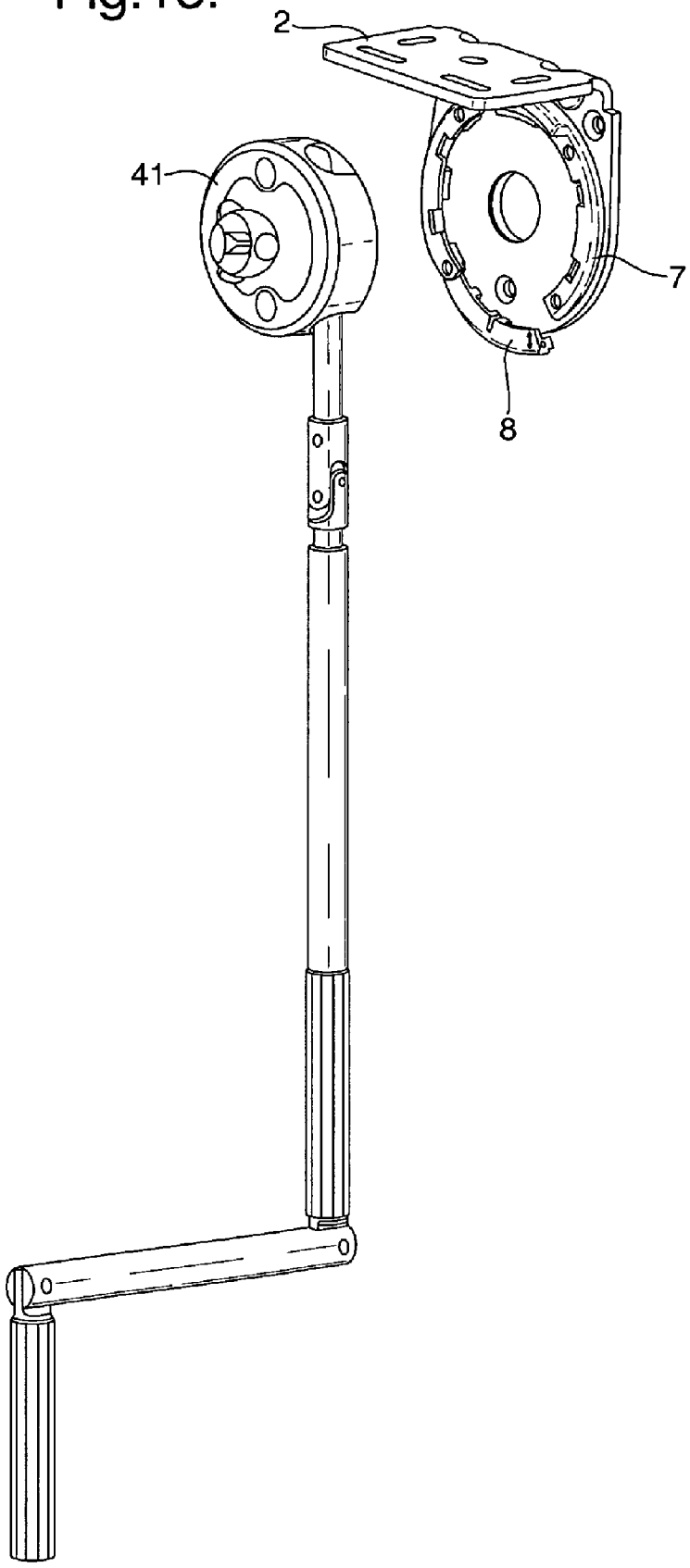
Figure 14:
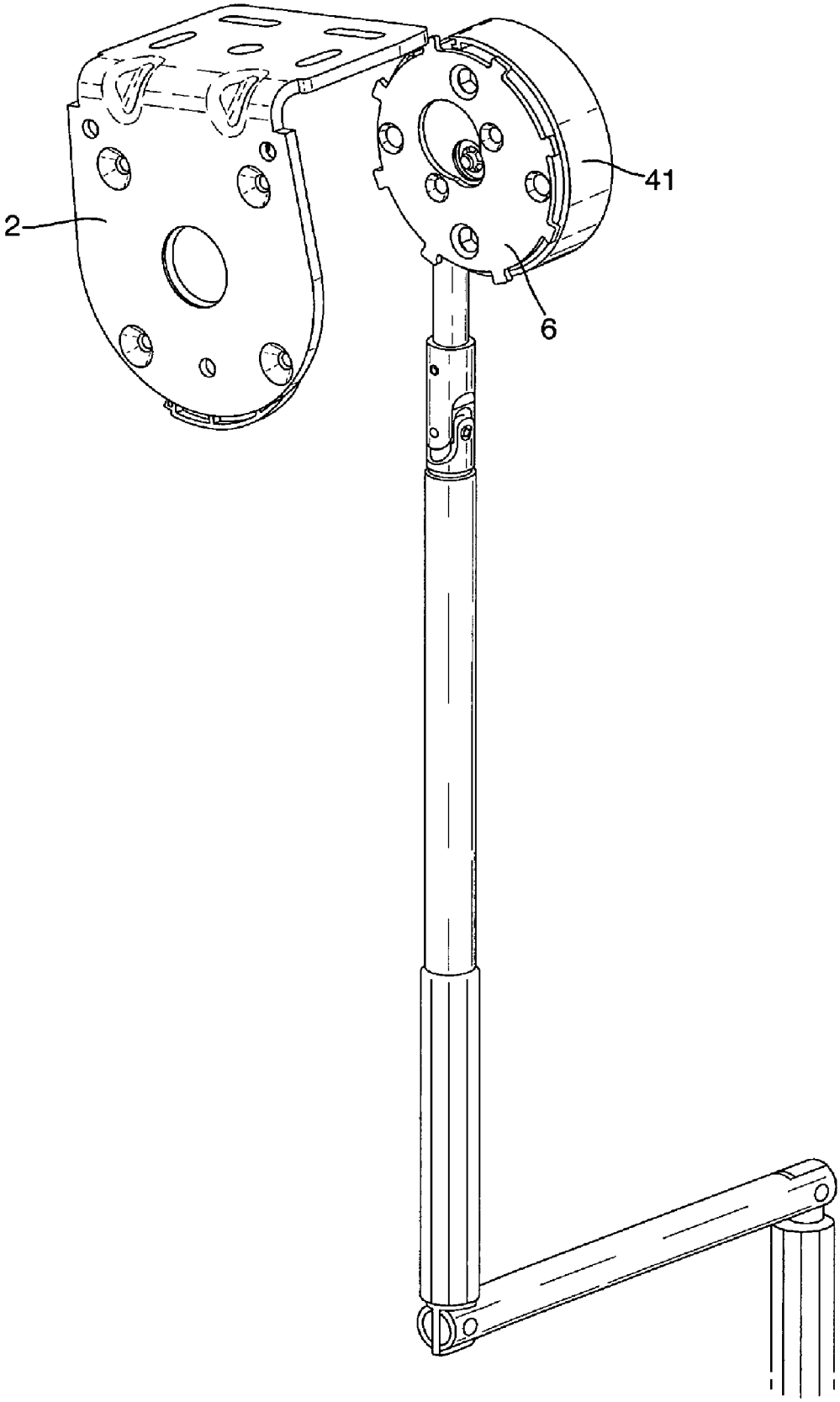
Figure 15:
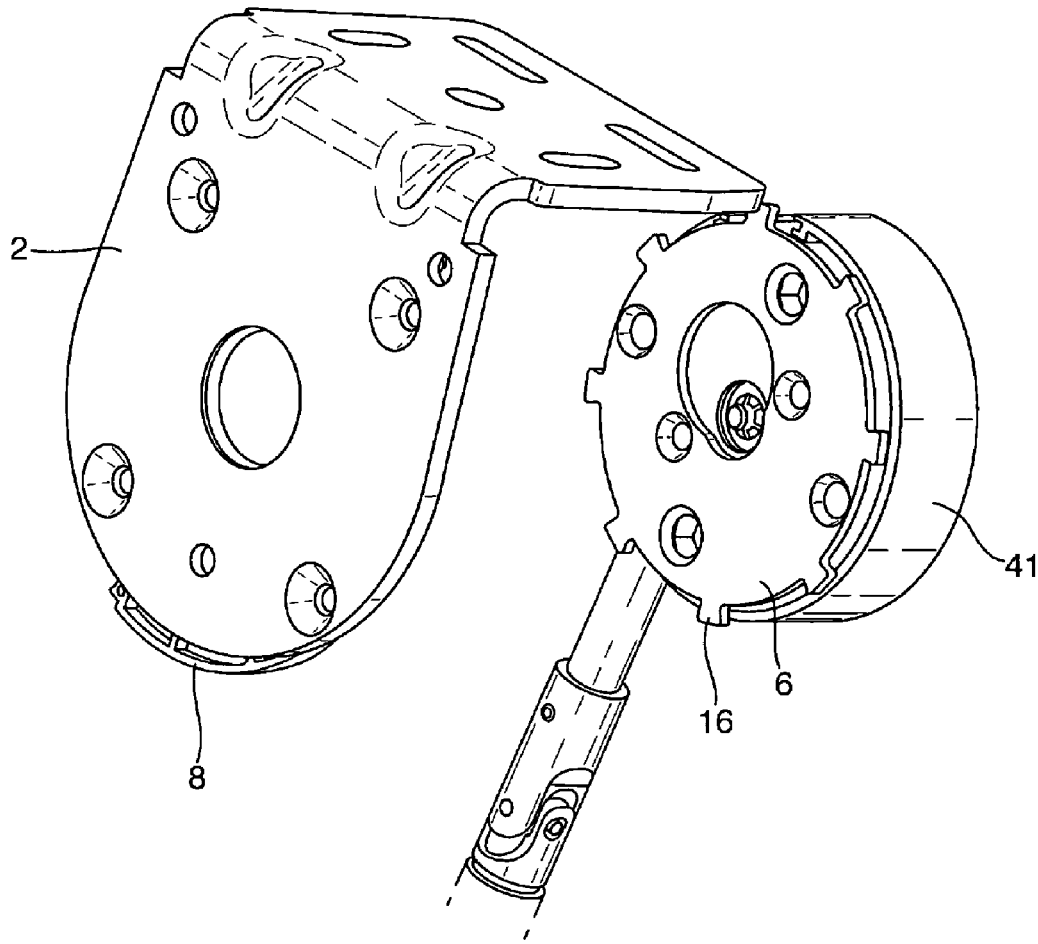

FIG. 11 depicts an exploded perspective view of the embodiment depicted in FIGS. 1 to 10 and may assist in understanding the invention.

It should be appreciated that, in the embodiment shown, when the adaptor plate 6 is inserted into the engagement member 7, one face of the adaptor plate 6 is immediately adjacent to the surface to which the engagement member 7 is mounted. Therefore, the thickness of the engagement member 7, and therefore the thickness of the connector 5 overall, is limited to the sum of the thickness of the adaptor plate 6 and the thickness of the front cover 17 of the engagement member 7. Accordingly, the connector 5 may be relatively thin, facilitating its use in a plurality of situations.

In the embodiment depicted in FIGS. 1 to 11, the adaptor plate includes eight radially outwardly projecting flanges 16 that are evenly spaced around the circular plate 15 of the adaptor plate 6. The front cover 17 of the engagement member 7 includes a sufficient number of openings 18 such that the adaptor plate 6 may be inserted into the engagement member 7. Accordingly, it will be appreciated that there are eight different orientations of the adaptor plate relative to the engagement member 7 at which the adaptor plate 6 may be inserted into the engagement member 7.

The provision of a relatively large number of orientations is beneficial for the user because it minimises the amount by which they must rotate the adaptor plate 6 from any given orientation in order to insert it into the adaptor plate 7. For example, with eight possible orientations, the maximum angle by which one must rotate the adaptor plate 6 from a given initial orientation in order to insert it into the engagement member 7 is 22.5°. This makes operation of the connector 5 easier for the user. It should be appreciated, however, that adaptor plate 6 with a different number of outwardly projecting flanges 16 may be used. Likewise, a different number of openings 18 in the front cover 17 of the engagement member 7 may be used. Furthermore, the outwardly projecting flanges 16 may be unevenly distributed around the circular plate 15 of the adaptor plate 6 if, for example, a particular orientation of the architectural covering is required.

It should be appreciated that the connector 5 may be used in a plurality of different situations. For example, although the arrangement depicted in FIGS. 1 to 11 depict its use with a tubular motor 1, it may, as depicted in FIGS. 12 to 15 or FIGS. 16 to 18, be used in an arrangement for mounting a crank-driven architectural covering or a ball-chain driven architectural covering, respectively, to an architectural surface. As shown, no modifications to the adaptor plate 6 or the engagement member 7, namely to the connector 5, are required to use the connector in these other situations.

As discussed above, the arrangement of the locking hatch is not limited to that depicted in FIGS. 1 to 18. For example, FIGS. 19 to 25 depict a connector 50 in which an alternative locking hatch 58 is provided. It will be appreciated that the connector 50 depicted in FIGS. 19 to 25 may otherwise be the same as the connector depicted in FIGS. 1 to 18 and accordingly only the differences will be discussed.

Figure 19:
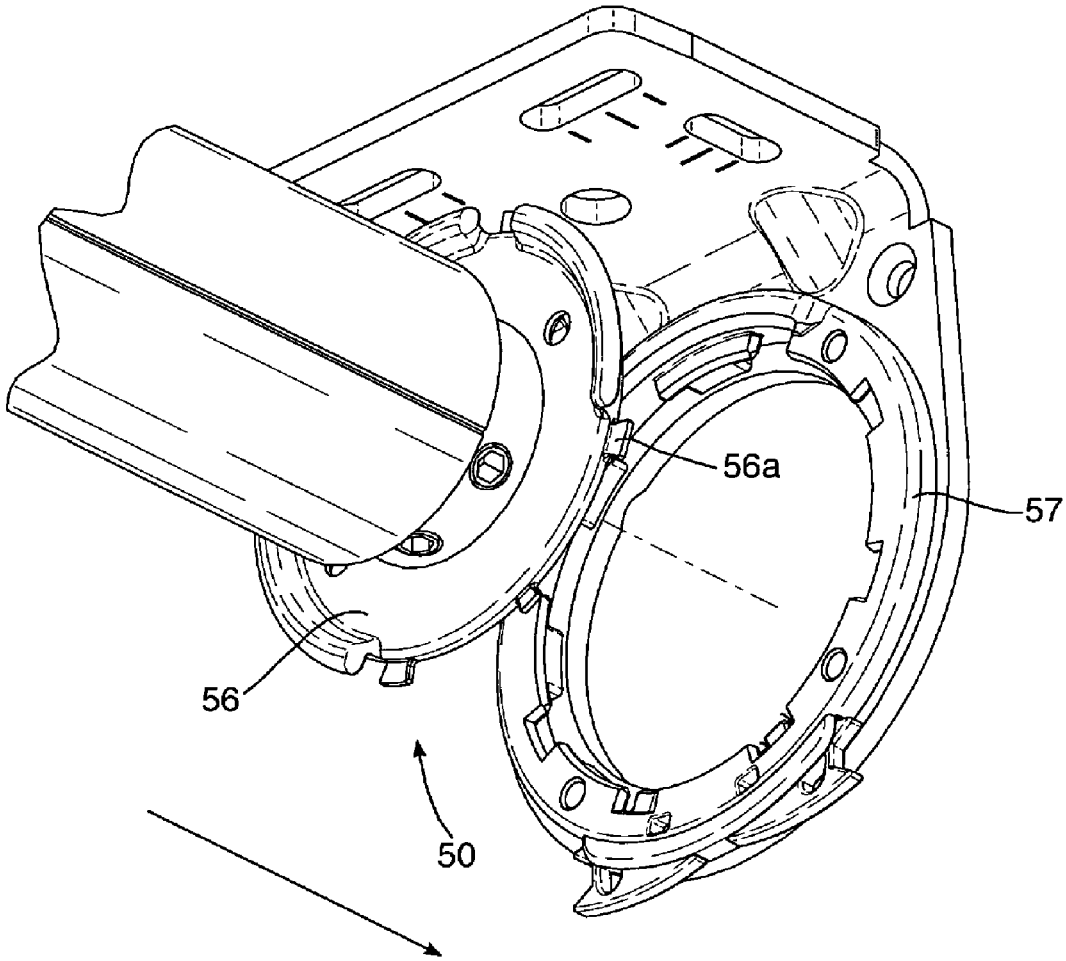
Figure 20:
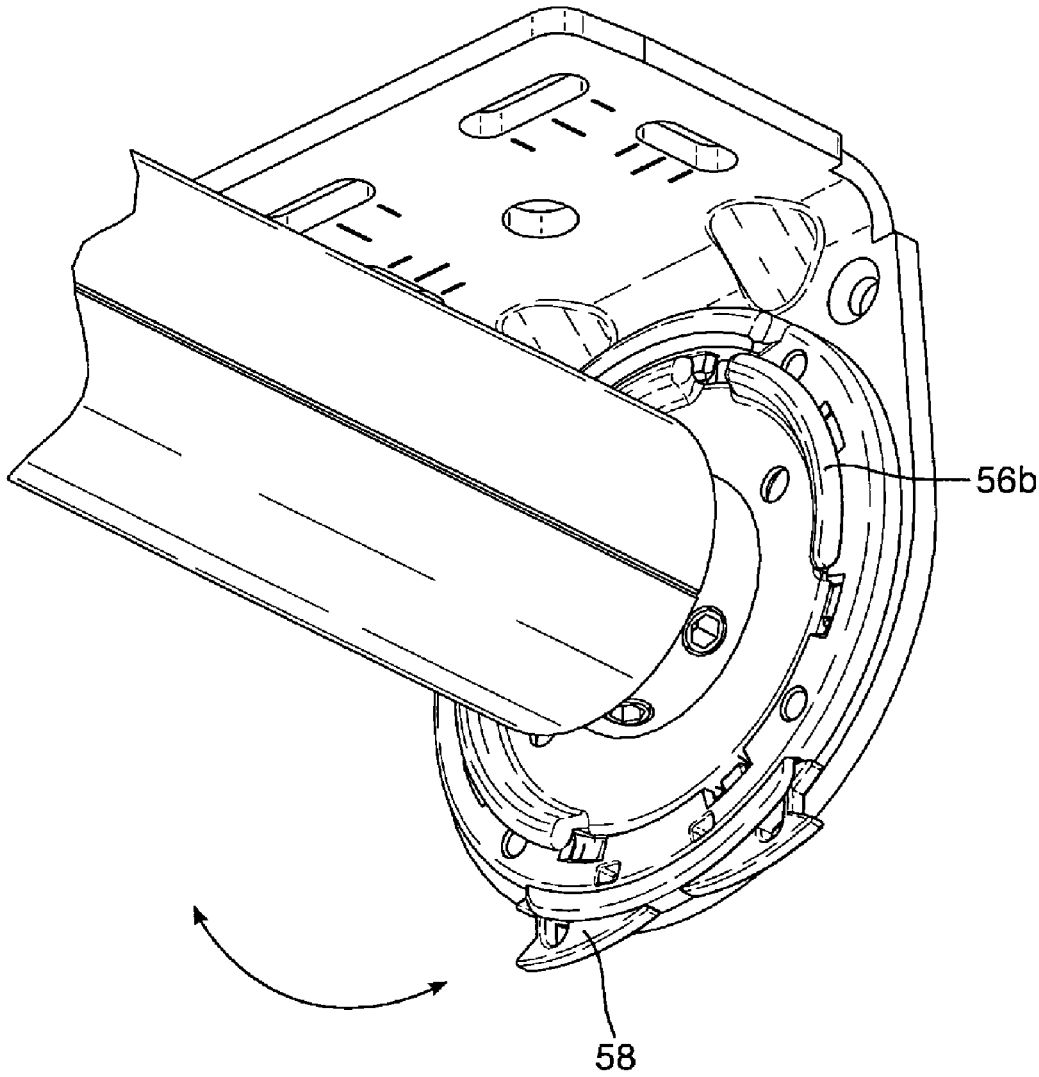
Figure 21:
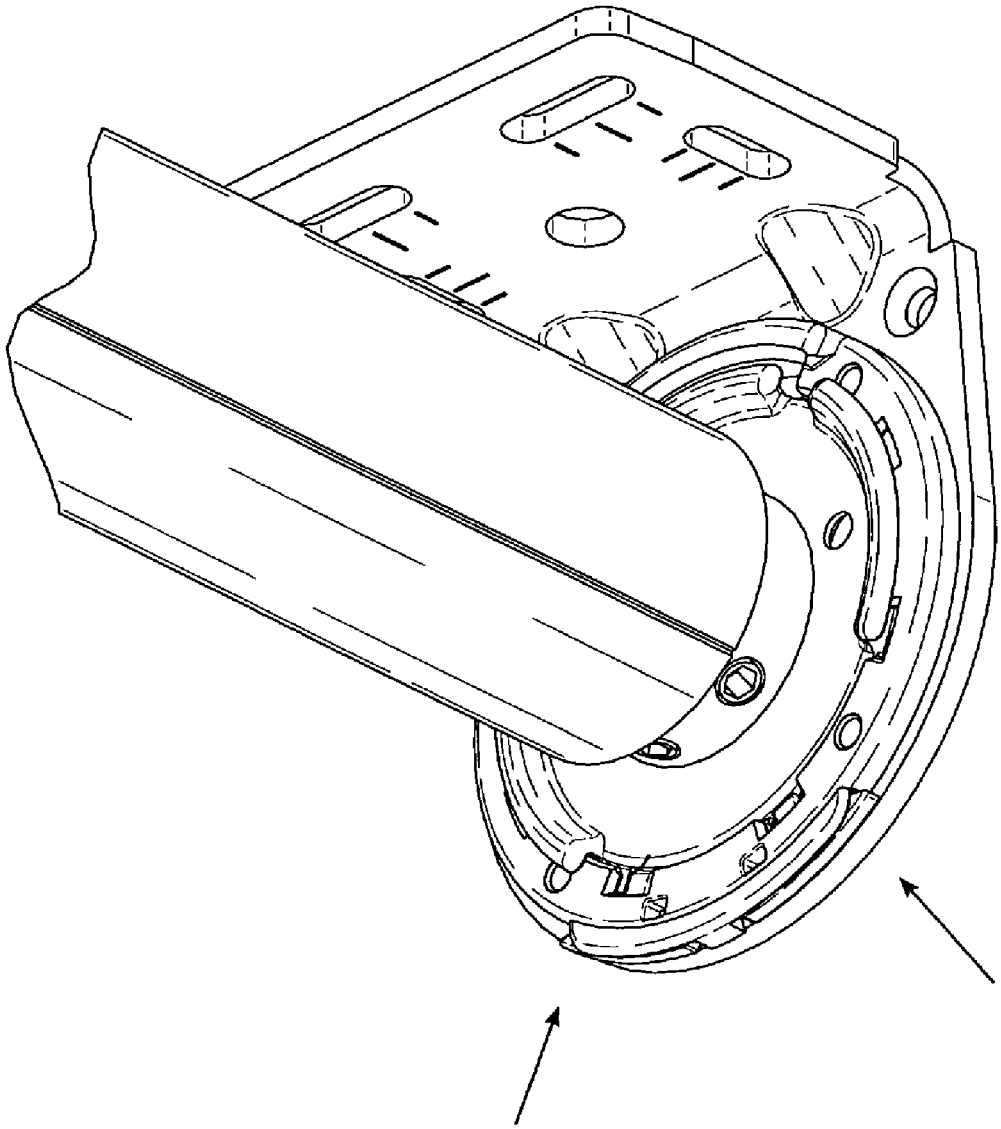

The locking hatch 58 of the connector 50 of FIGS. 19 to 25 is, as before, provided to interact with the adaptor plate 56 when it is inserted in the engagement member 57 such that the adaptor plate 56 is prevented from rotating relative to engagement member 57. FIG. 19 depicts the connector 50 before connection of the adaptor plate 56 to the engagement member, with the locking hatch 58 in an open position; FIG. 20 depicts the connector 50 once the adaptor plate 56 has been inserted into the engagement member 57 and rotated relative to the engagement member in order to form the connection; and FIG. 21 depicts the connector 50 once the locking hatch 58 has been closed, preventing the adaptor plate 56 from rotating relative to, and releasing from, the engagement member 57.

Figure 22:
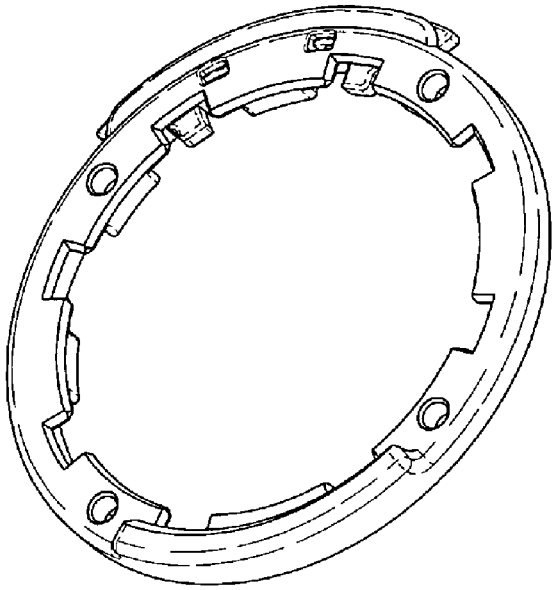
Figure 23:
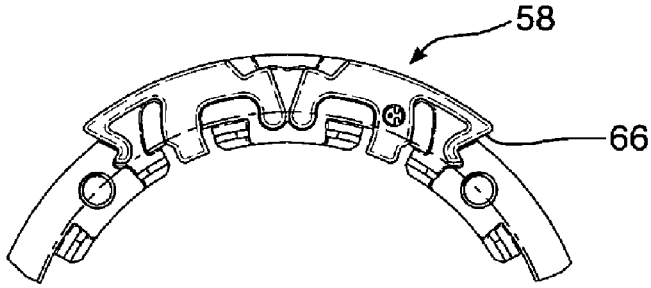
Figure 24:
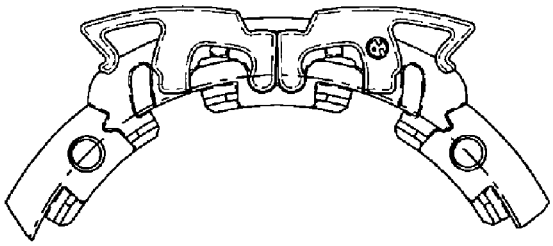
Figure 25:
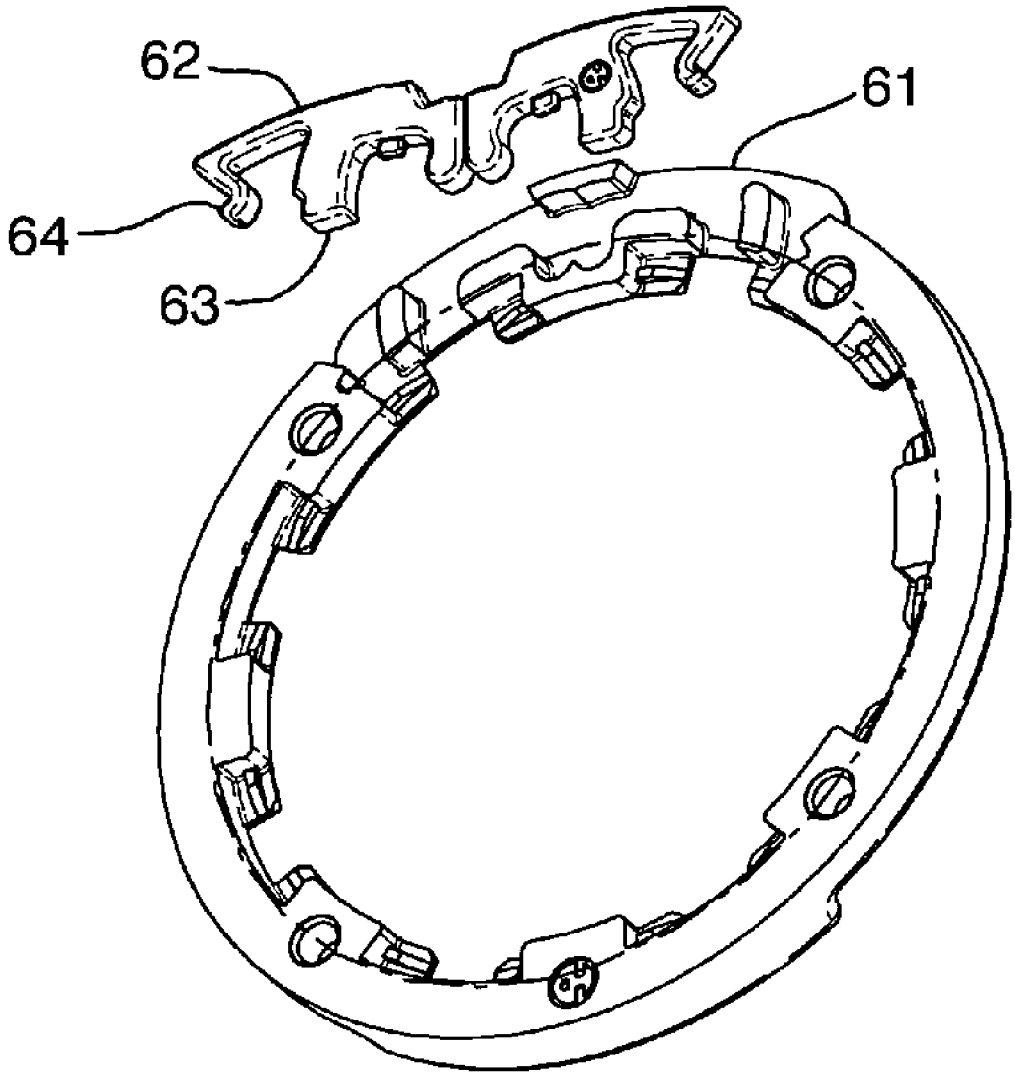

FIGS. 22 to 25 depict in more detail the form and function of the locking hatch 58, FIG. 22 depicting the front side of an engagement member having locking hatch 58 in the closed position, FIG. 23 depicting the rear side of the engagement member with the locking hatch closed, FIG. 24 depicting the rear side of the engagement member with the locking hatch open and FIG. 25 depicting an exploded diagram of the engagement member.

As shown, the locking hatch 58 may include a base 61 that is fixedly attached to, or part of, the engagement member 57. A pair of rotatable catches 62 are mounted to the base such that they can rotate relative to the base 61 between open and closed positions that correspond to the opening and closing of the locking hatch 58. Each catch 62 includes a protrusion 63 that, when the locking hatch, and therefore the catch, is in the closed position, engages with one of the radially outwardly projecting flanges 56*a* of the adaptor plate 56 in order to prevent rotation of the adaptor plate 56 relative to the engagement member 57. When the locking hatch, and therefore the catch, is in the open position, the catch is rotated away from the adaptor plate 56 such that the protrusion 63 does not prevent rotation of the adaptor plate relative to the engagement member.

Each of the catches 62 further includes a snap-fit connector 64 that, when the catch 62 is closed, engages with the base 61 of the locking hatch 58 in order to prevent accidental opening of the locking hatch. As shown, the snap-fit connector 64 may be configured to interact with an edge of the base 61 of the locking hatch that is furthest away from the point on the base about which the catch rotates. This may provide a relatively strong connection, namely one that is relatively unlikely to be accidentally opened.

However, it will be appreciated that the snap-fit connector 64 may be arranged in a number of different ways. For example, the snap fit connector 64 of the catch 62 may engage with a protrusion of the base 61 that, when the catch is closed, is located between the protrusion 63 of the catch and the snap-fit connector 64. Such an arrangement may assist in providing a more compact arrangement of the locking hatch.

In order to assist the user in opening the locking hatch 58, the catch 62 may include a lift point 66, which protrudes from the locking hatch 58 when it is closed and which may be of a sufficient size that a user may insert a tool or part of their finger beneath in order to open the locking hatch.

Finally, it will be appreciated that, although in FIGS. 19 to 25 and as described above, a locking hatch is depicted that has two catches having respective protrusions 63 arranged to prevent rotating of the adaptor plate 56 once the locking hatch is closed, it will be appreciated that other arrangements may be provided. For example additional catches may be provided to reduce the likelihood of an accidental release. Likewise only a single catch may be provided if, for example, the engagement member is configured such that the adaptor plate, once inserted, must be rotated in a particular direction to complete the connection.

FIGS. 19 to 21 also depict a further variation of the present invention that may be used in conjunction with any of the arrangements of a connector discussed above. In this arrangement, as shown, the adaptor plate 56 has three flanged rims 56*b*.

The flanged rims 56*b* project outwardly from the centre of the adaptor plate 56 in a similar manner as the radially outwardly projecting flanges 56*a*. However, the flanged rims 56*b* are arranged such that when the adaptor plate 56 is inserted into the engagement member 57, the flanged rims 56*b* abut the front surface of the engagement member 57. This may assist the user in correctly positioning the adaptor plate 56 relative to the engagement member 57, specifically preventing the adaptor plate from moving too far in the initial insertion direction before being rotated relative to the engagement member. This may be especially beneficial if the engagement member is not mounted adjacent a solid surface.

As depicted, the adaptor plate may include three flanged rims 56*b* and five radially outwardly projecting flanges 56*a*. However, as depicted, the radially outwardly projecting flanges 56*a* may be arranged such that they are appropriately positioned such that they may be inserted into openings in an engagement member 57 having eight openings evenly spaced around the front surface of the engagement member as described above in relation to the arrangements depicted in FIGS. 1 to 18. As explained above, therefore, the maximum angle by which one must rotate the adaptor plate 56 from a given initial orientation in order to insert it into the engagement member 57 is 22.5°. This makes operation of the connector simple for the user.

It will be appreciated that the adaptor plate may have a different number of flanged rims 56*b*, such as one, two or more than three. Likewise, it will be appreciated that the adaptor plate may have any convenient number of radially outwardly projecting flanges 56*a*.

The invention claimed is:

1. A connector for connecting an architectural covering to a surface, comprising:

an adapter plate, comprising a substantially circular plate and one or more radially outwardly projecting flanges;

a ring-shaped engagement member, having one or more openings in a front cover; wherein the adapter plate and the engagement member are configured such that the adapter plate is insertable into the engagement member by aligning the one or more flanges of the adapter plate with a respective opening in the front cover of the engagement member;

removal of the adapter plate from the engagement member is subsequently prevented by a partial rotation of the adapter plate relative to the engagement member such that at least a part of one of the flanges of the adapter plate is no longer aligned with an opening in the front cover of the engagement member;

wherein the engagement member further comprises a rotably mounted locking member which, in a first position, allows free rotation of the adapter plate relative to the engagement member and, in a second position, engages the adapter plate, limiting rotation of the adapter plate relative to the engagement member to prevent removal of the adapter plate from the engagement member.

2. A connector according to claim 1, wherein the rotatably mounted locking member comprises an arc-shaped portion of the ring-shaped engagement member and is hinged at one end of the arc; wherein, when the locking member is in the second position it completes the ring shape of the engagement member.

3. A connector according to claim 1 or 2, wherein the locking member is biased towards the second position.

4. A connector according to claim 1, wherein the locking member further comprises a snap-fit connector, arranged to retain the locking member in the second position.

5. A connector according to any one of claim 1, 2 or 4, wherein the engagement member further comprises at least one means for preventing continuous rotation of the adapter plate relative to the engagement member, configured such that, when the adapter plate is inserted into the engagement member and rotated to prevent removal of the adapter plate, the at least one means for preventing continuous rotation of the adapter plate relative to the engagement member stops the rotation at an orientation that permits the locking member to engage with at least one of the one or more flanges of the adapter plate.

6. A connector according to claim 5, wherein the at least one means for preventing continuous rotation of the adapter plate relative to the engagement member comprises at least one radially inwardly projecting flange configured to stop the rotation when one of the flanges of the adapter plate abuts a flange of the engagement member.

7. A connector according to claim 1, wherein there are a plurality of orientations of the adapter plate relative to the engagement member at which the adapter plate is insertable into the engagement member.

8. A connector according to claim 7, wherein the plurality of orientations comprises eight or more orientations.

9. A connector according to claim 1, wherein, when the engagement member is mounted to a surface and the adapter plate is inserted into the engagement member, the adapter plate is immediately adjacent the surface.

10. A connector according to claim 1, wherein the adapter plate and the engagement member are configured such that the adapter plate is rotatable relative to the engagement member in either direction to prevent subsequent removal of the adapter plate from the engagement member.

11. A connector according to claim 1, further comprising means for connecting the adapter plate to the architectural covering.

12. A connector according to claim 1, further comprising means for connecting the engagement member to the surface.

13. A connector according to claim 12, wherein the engagement member is configured such that the means for connecting the engagement member to the surface connects the engagement member directly to a wall or architectural surface.

14. A connector according to claim 12 or 13, wherein the engagement member is configured such that the means for connecting the engagement member to the surface connects the engagement member to a bracket, the bracket configured to be connected to a wall or architectural surface.

15. A connector according to claim 12 or 13, wherein the means for connecting the engagement member to the surface comprise through holes in the engagement member for receiving fixing means; and the through holes are located in the front cover of the engagement member.

16. A connector according to claim 1, wherein when in the second position, the locking member prevents rotation of the adapter plate relative to the engagement member.

* * * * *